US009492340B2

(12) United States Patent
Hornbach et al.

(10) Patent No.: US 9,492,340 B2
(45) Date of Patent: Nov. 15, 2016

(54) COMBINED SIDERAIL AND OVER-BED TABLE

(75) Inventors: David W. Hornbach, Batesville, IN (US); Richard H. Heimbrock, Cincinnati, OH (US); Jonathan D. Turner, Dillsboro, IN (US); Stephen Hutchison, Batesville, IN (US); Joseph A. Ernst, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 1215 days.

(21) Appl. No.: 12/701,042

(22) Filed: Feb. 5, 2010

(65) Prior Publication Data

US 2011/0191957 A1 Aug. 11, 2011

(51) Int. Cl.

| | |
|---|---|
| ***A47B 23/02*** | (2006.01) |
| ***A61G 7/05*** | (2006.01) |
| *A61G 7/00* | (2006.01) |

(52) U.S. Cl.

CPC ..... *A61G 7/0507* (2013.01); *A61G 7/0005* (2013.01); *A61G 2007/0513* (2013.01); *A61G 2007/0514* (2013.01); *A61G 2007/0516* (2013.01)

(58) Field of Classification Search

CPC ..... A61G 7/0507; A61G 7/0005; A61G 2007/0513; A61G 2007/0514; A61G 2007/0516

USPC ..... 5/658, 662, 507.1, 503.1, 424, 425, 5/428, 429, 430

See application file for complete search history.

(56) References Cited

U.S. PATENT DOCUMENTS

| | | | | |
|---|---|---|---|---|
| 3,543,312 | A | 12/1970 | Pofferi | |
| 5,035,464 | A * | 7/1991 | Spallholtz | 5/507.1 |
| 5,038,434 | A | 8/1991 | Navarrette | |
| 5,279,010 | A | 1/1994 | Ferrand | |
| 5,315,726 | A | 5/1994 | Borenstein | |
| 5,359,741 | A | 11/1994 | Lang | |
| 5,575,535 | A | 11/1996 | Burchett et al. | |
| 5,606,917 | A | 3/1997 | Cauffiel | |
| 6,195,820 | B1 * | 3/2001 | Heimbrock et al. | 5/507.1 |
| 6,862,759 | B2 | 3/2005 | Hand | |
| 6,957,461 | B2 | 10/2005 | Osborne | |
| 7,017,208 | B2 | 3/2006 | Weismiller | |
| 7,082,882 | B2 | 8/2006 | Heimbrock | |
| 7,234,182 | B2 * | 6/2007 | Miller et al. | 5/507.1 |
| 7,243,386 | B2 | 7/2007 | Gallant | |
| 7,472,439 | B2 | 1/2009 | Lemire | |
| 7,600,277 | B2 * | 10/2009 | Heimbrock | 5/136 |
| 2006/0056616 | A1 | 3/2006 | Heimbrock | |

(Continued)

FOREIGN PATENT DOCUMENTS

| | | |
|---|---|---|
| GB | 19806 | 0/1910 |
| GB | 2458164 A | 9/2009 |

OTHER PUBLICATIONS

Extended EP Search Report; Date of Completion of the Search—Jan. 31, 2013; Place of Search—The Hague; Date Mailed—Feb. 11, 2013.

(Continued)

*Primary Examiner* — David E Sosnowski
(74) *Attorney, Agent, or Firm* — Kenneth C. Baran

(57) ABSTRACT

A combined siderail/over-bed table unit 42 for a bed 20 has a table position in which at least part 62 of the unit overlies a mattress region 48 of the bed thereby serving as an over-bed table and also has a siderail position allowing the unit to serve as a siderail.

21 Claims, 23 Drawing Sheets

(56) References Cited

U.S. PATENT DOCUMENTS

| | | | |
|---|---|---|---|
| 2007/0174965 | A1 | 8/2007 | Lemire |
| 2008/0235872 | A1 | 10/2008 | Newkirk |
| 2009/0064415 | A1 | 3/2009 | Payne |

OTHER PUBLICATIONS

Communication pursuant to Article 94(3) EPC for EP Application No. 11152518.4, mailed Aug. 14, 2014; received Aug. 19, 2014.

* cited by examiner

COMBINED SIDERAIL AND OVER-BED TABLE

TECHNICAL FIELD

The subject matter described herein relates to a multi-functional unit capable of serving as a bed siderail and as an over-bed table. One example application for the unit is as a feature of a bed used in a health care facility or in a home care setting.

BACKGROUND

Beds used in health care facilities and in home care settings may be equipped with a dedicated table permanently affixed to the bed and positionable over the thighs of an occupant of the bed. Such tables can usually be repositioned when not in use by the occupant or when a caregiver requires access to the occupant. Other styles of table are non-permanently attachable to the bed. Still other table styles have a C-shaped profile featuring horizontally extending base and tray portions connected to each other by a vertical support. When in use as an overbed table the base portion fits laterally underneath the bed, the tray portion extends laterally across the bed at an elevation higher than the occupant's thighs, and the support extends vertically near the left or right side of the bed.

Despite the usefulness of the above described tables, they are not without certain shortcomings. Permanently attached, dedicated tables add to the weight and complexity of the bed. Non-permanently attachable tables require effort to be attached to and detached from the bed and contribute to facility clutter when not in use. The C-shaped table, while convenient to position and reposition, expands the "footprint" of the bed when in use and contributes to facility clutter when not in use.

It is, therefore, desirable to reduce the weight, complexity, effort of use, floor space consumption and clutter associated with conventional over-bed tables.

SUMMARY

A combined siderail/over-bed table unit for a bed has a table position in which at least part of the unit overlies a mattress region of the bed thereby serving as an over-bed table and also has a siderail position allowing the unit to serve as a siderail.

BRIEF DESCRIPTION OF THE DRAWINGS

The foregoing and other features of the various embodiments of the innovation described herein will become more apparent from the following detailed description and the accompanying drawings in which.

DETAILED DESCRIPTION

Figure 1:
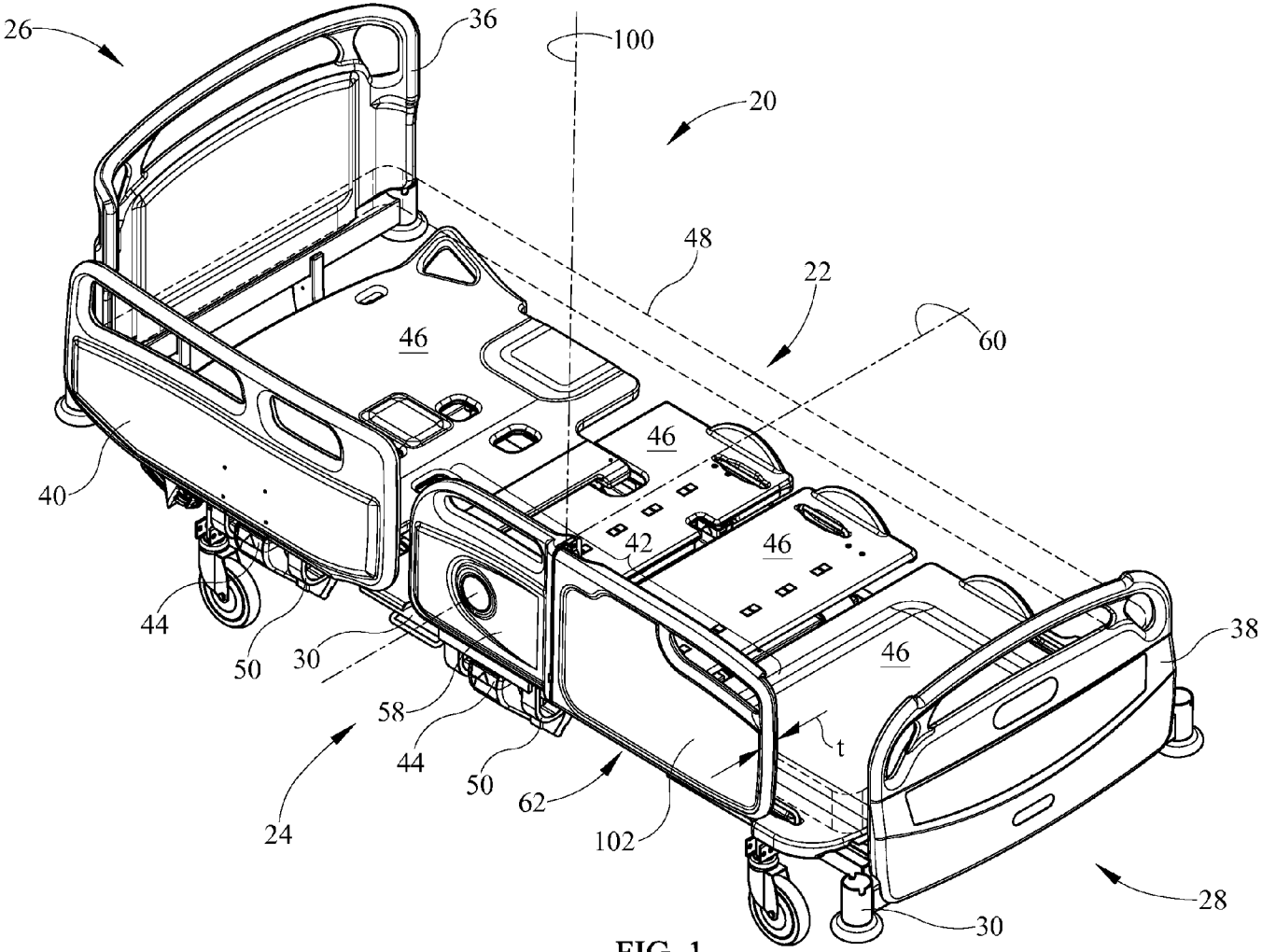
FIG. 1 is a perspective view of a hospital bed showing frame, deck, side rail and combined side rail/over-bed table components as well as a region for a mattress.

FIG. 1 shows a hospital bed 20 having a left side 22 a right side 24 laterally spaced from the right side, a head end 26 and a foot end 28 longitudinally spaced from the head end. The bed includes a frame 30, a headboard 36 and a footboard 38 attached to the frame, and left and right head end siderails 40, only the right one of which is shown. The bed also includes at least one siderail/over-bed table (OBT) unit 42, shown on the right side of the bed near the foot end. The left side foot end of the bed may have a similar unit or may have a conventional foot end siderail. The frame also includes one or more deck sections 46, at least one of which is orientation adjustable. The frame defines, at least in part, a spatial region 48, shown in phantom, for a mattress. The mattress region has dimensions corresponding to a mattress, not shown, intended to be placed on the frame.

Figure 2:
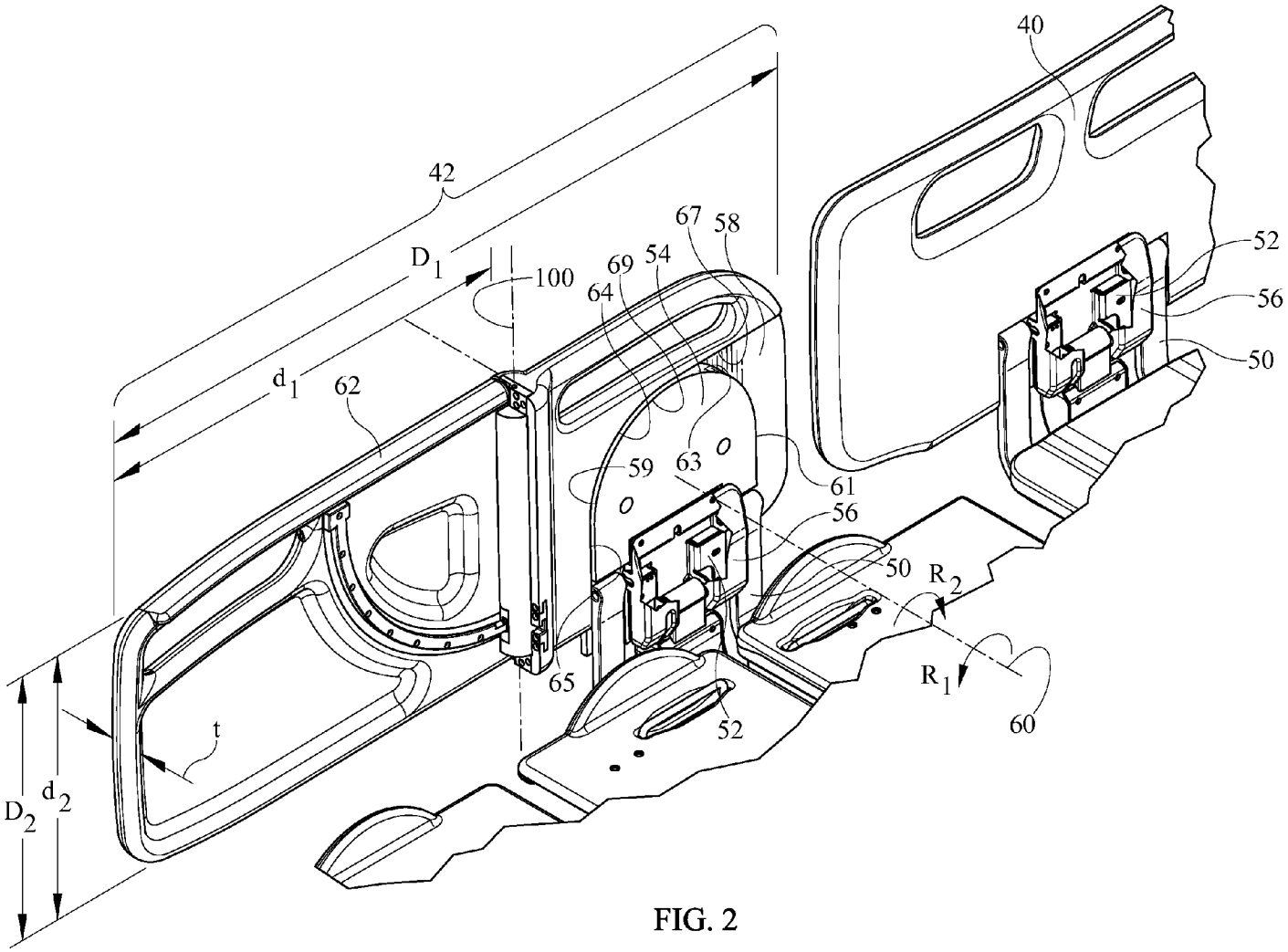
FIG. 2 is a perspective view of the siderail/over-bed table of FIG. 1 as seen from the occupant's side of the siderail/over-bed table unit.
Figure 3B:
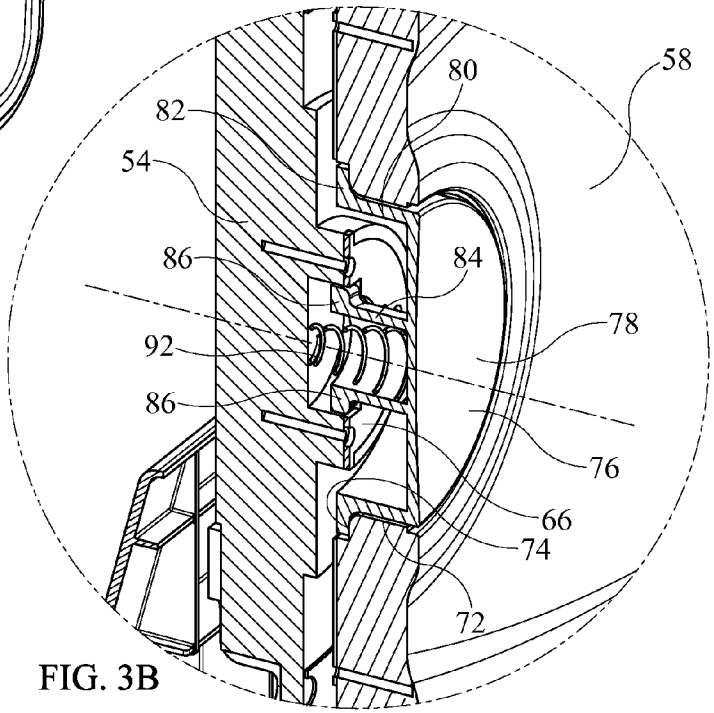
FIG. 3B is an enlarged view of a portion of FIG. 3A.
Figure 3A:
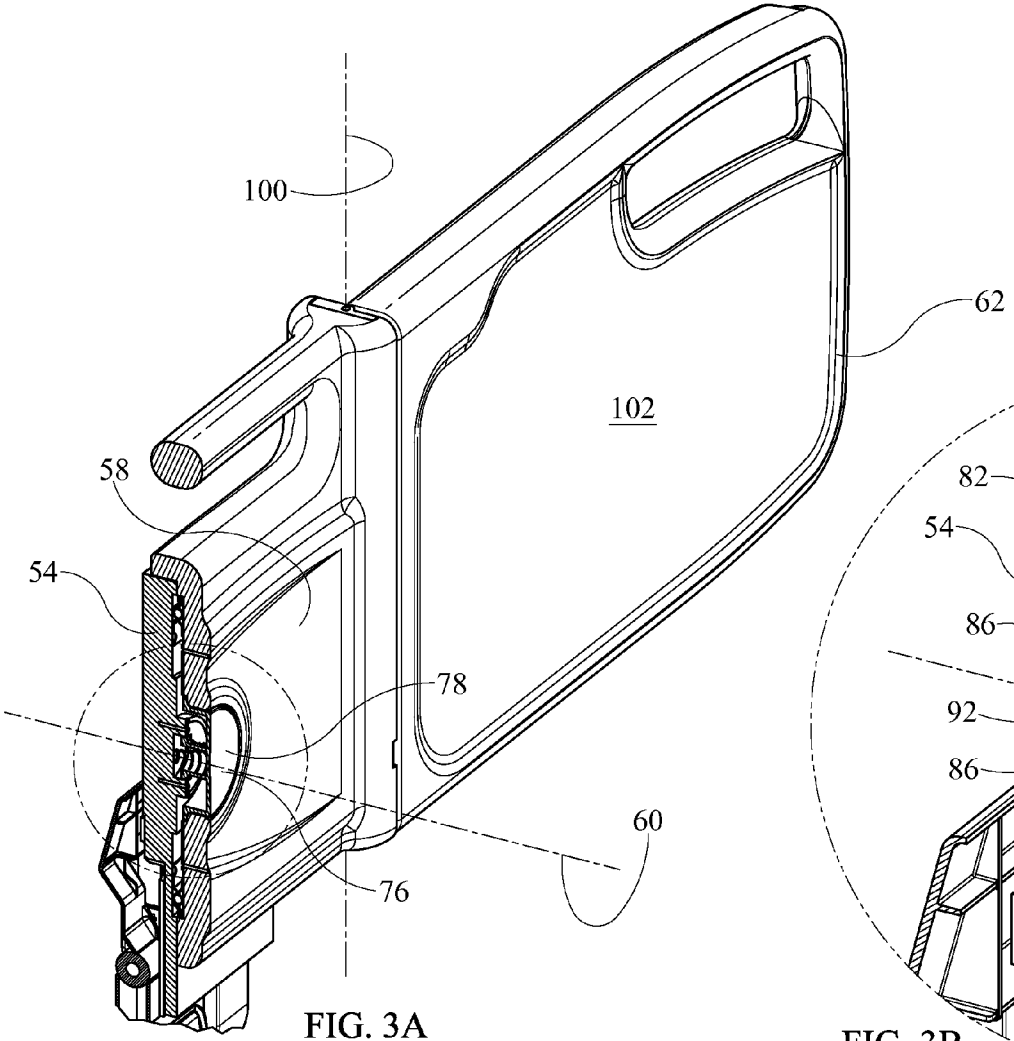
FIG. 3A is a view of the siderail/over-bed unit of FIG. 2 cutaway to reveal internal components of the unit, including a button shown in a neutral state.
Figure 5:
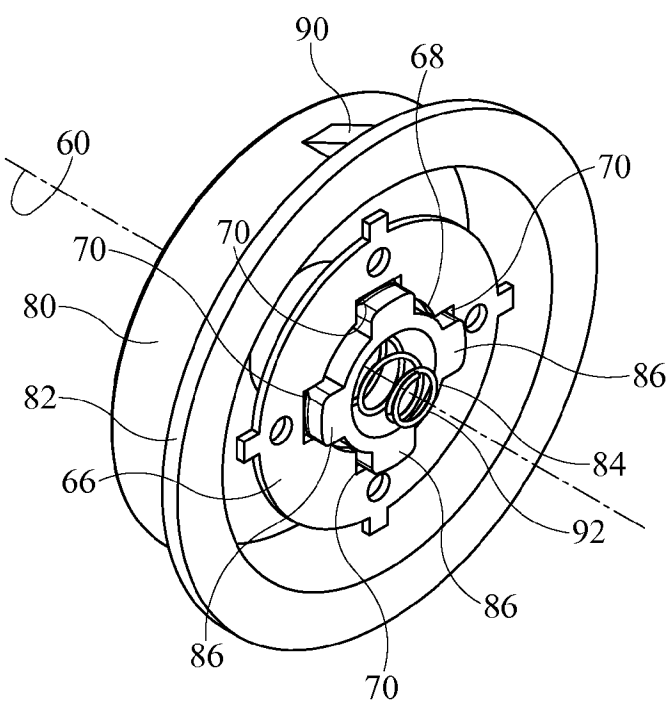
FIG. 5 is an assembled view of the components of FIG. 4.
Figure 4:
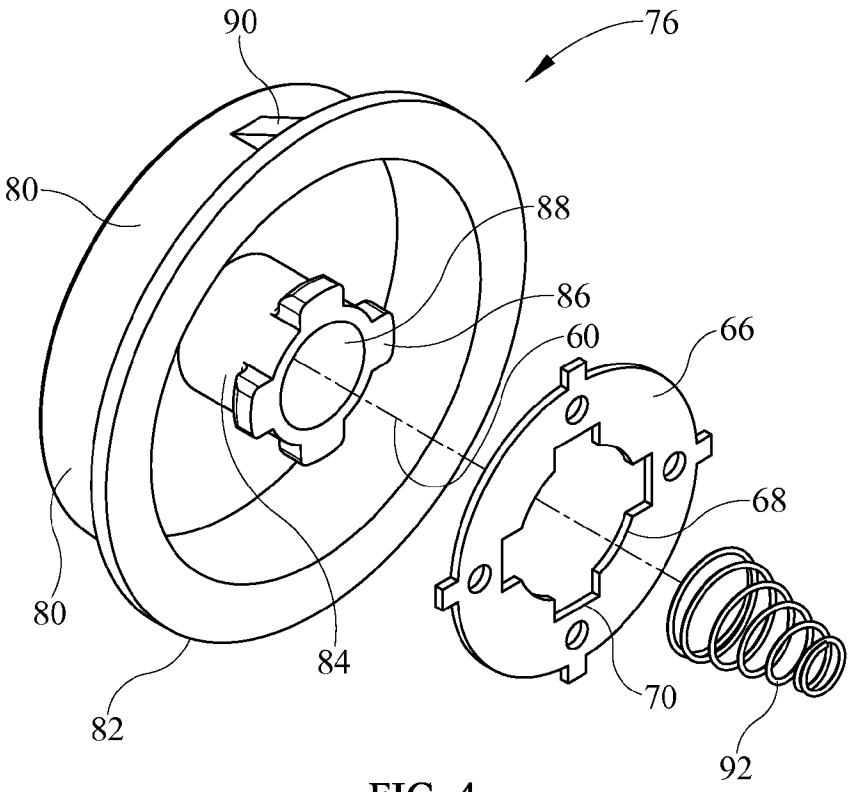
FIG. 4 is an exploded view of components visible in FIGS. 3A and 3B.
Figure 6:
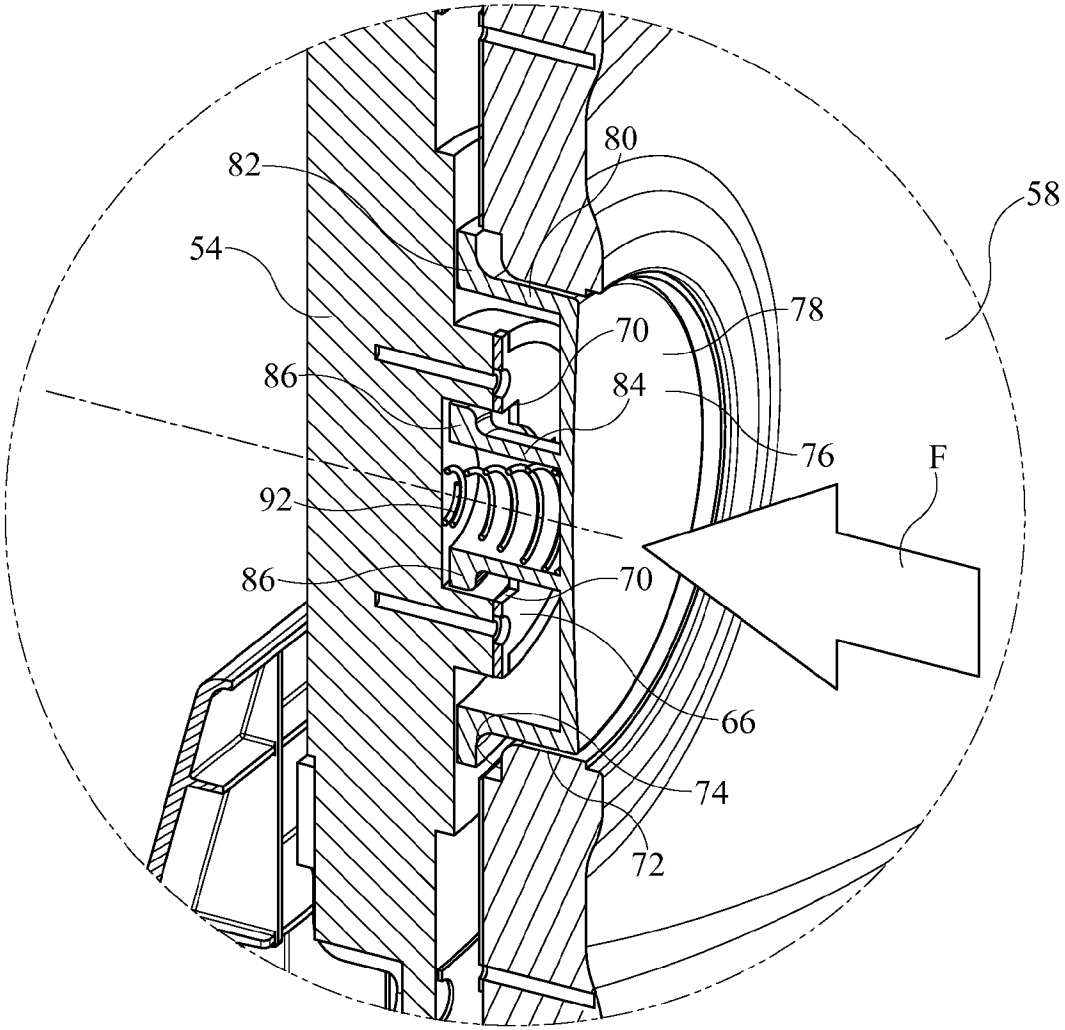
FIG. 6 is a view similar to FIG. 3B showing the button in a depressed state.

Referring additionally to FIG. 2 the frame also includes four mechanisms 50 each having a mounting plate 52 concealed under a plastic cover 56 Each mounting plate is associated with either one of the conventional siderails or with the combined siderail/OBT unit 42. The illustrated mechanisms are four bar linkage "drop down" mechanisms. Each mechanism associated with a siderail is connected to the siderail to support the siderail and allow it to be moved vertically between a raised or deployed position, as shown, and a lowered or retracted position. The mechanism includes a latch (not depicted) to secure the siderail or combined siderail/OBT in the raised position. A release handle 44 is provided to allow a user to release the latch. The mounting plate 52 of the mechanism associated with the siderail/OBT unit is connected to a base plate 54, which is stationary relative to the mounting plate. The base plate connects the combined siderail/OBT unit 42 to the mechanism 50, to support the unit and allow it to be moved vertically between raised and lowered positions. The mechanism includes a latch (not depicted) to secure the combined siderail/OBT in the raised position. A release handle 44 is provided to allow a user to release the latch. The connection between the siderail/OBT unit and the frame is a permanent connection in that the siderail/OBT, despite being attached to the frame, is not normally intended to be easily detached from the frame.

As seen best in FIGS. 1 and 2 the siderail/OBT has a siderail position in which the unit borders the mattress region 48 thereby serving as a siderail. As a practical matter, the unit, when in its siderail position, is immediately proximate to the lateral extremity of the mattress region 48 so that the unit is sufficiently close to the mattress to serve as a siderail. That is, the unit is laterally outboard of the mattress, but close enough to the mattress to not leave an objectionably large lateral gap between the unit and the mattress. The thickness t of the unit is small in comparison to its other two dimensions, $D_1$ and $D_2$, therefore the unit extends predominantly in the longitudinal and vertical directions when in the siderail position.

Figure 12:
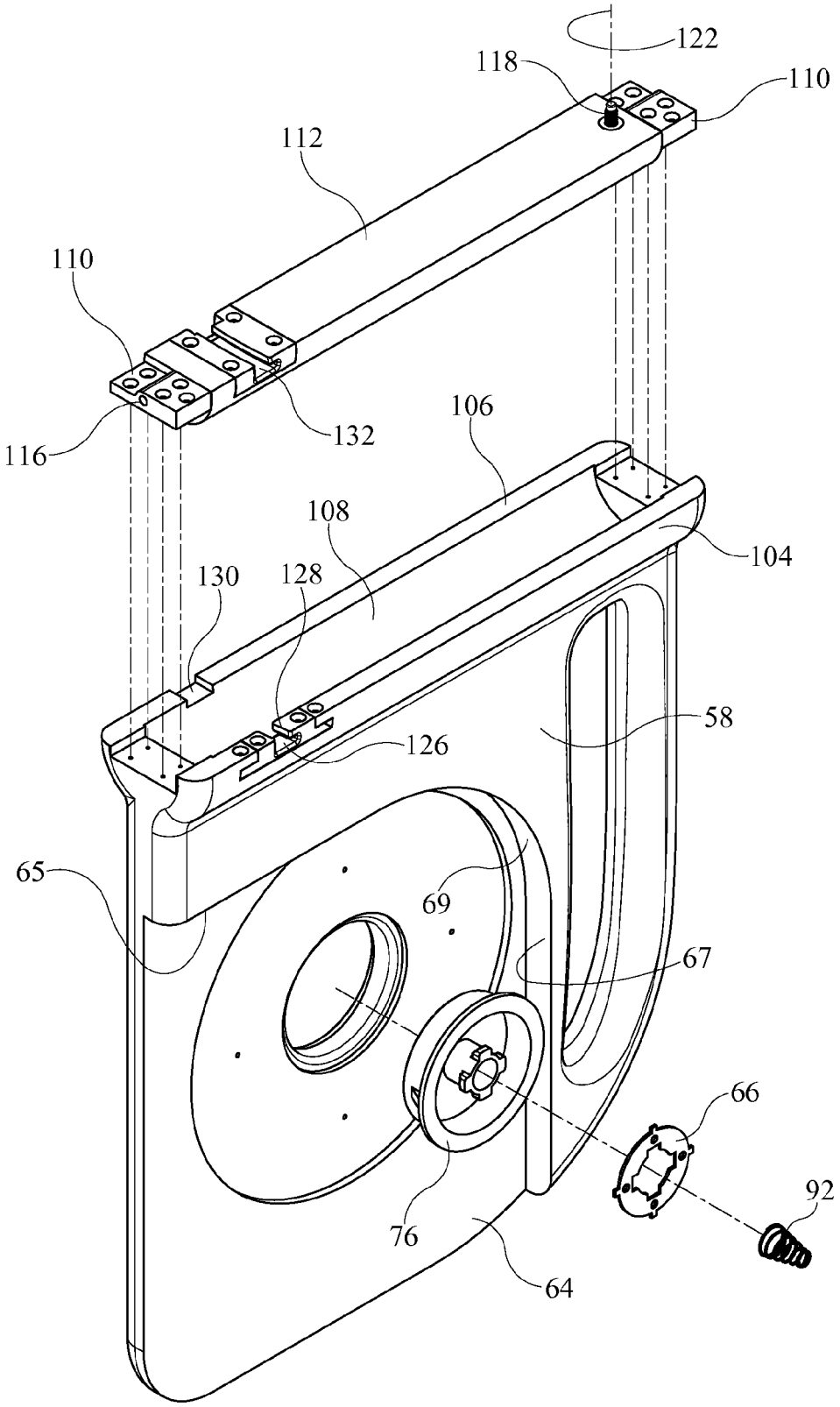
FIG. 12 is a view of the heel component of FIG. 11 with selected components having been assembled.
Figure 13:
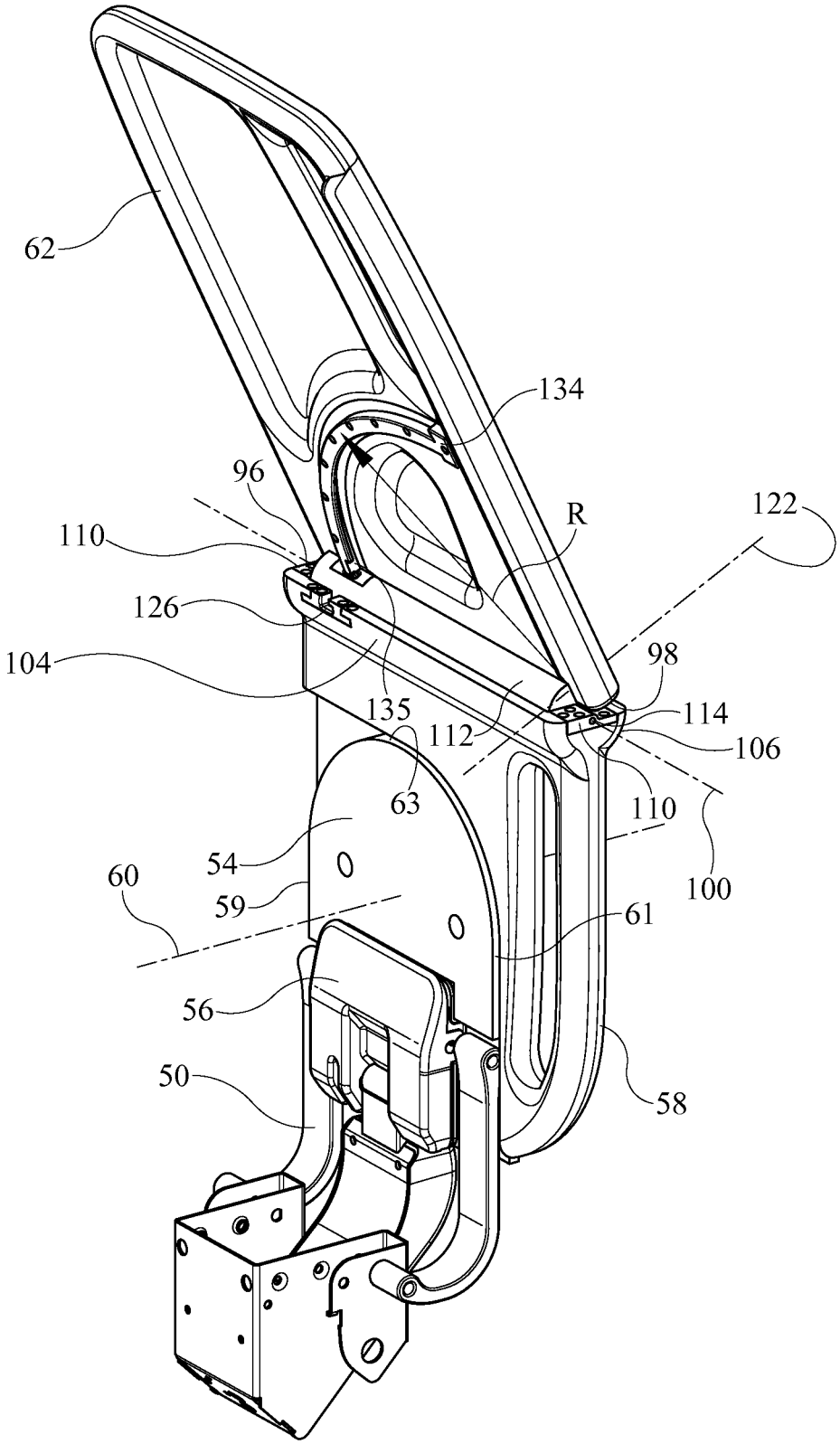
FIG. 13 is a view similar to FIG. 8 as seen by an observer positioned more toward the head end of the bed.
Figure 14:
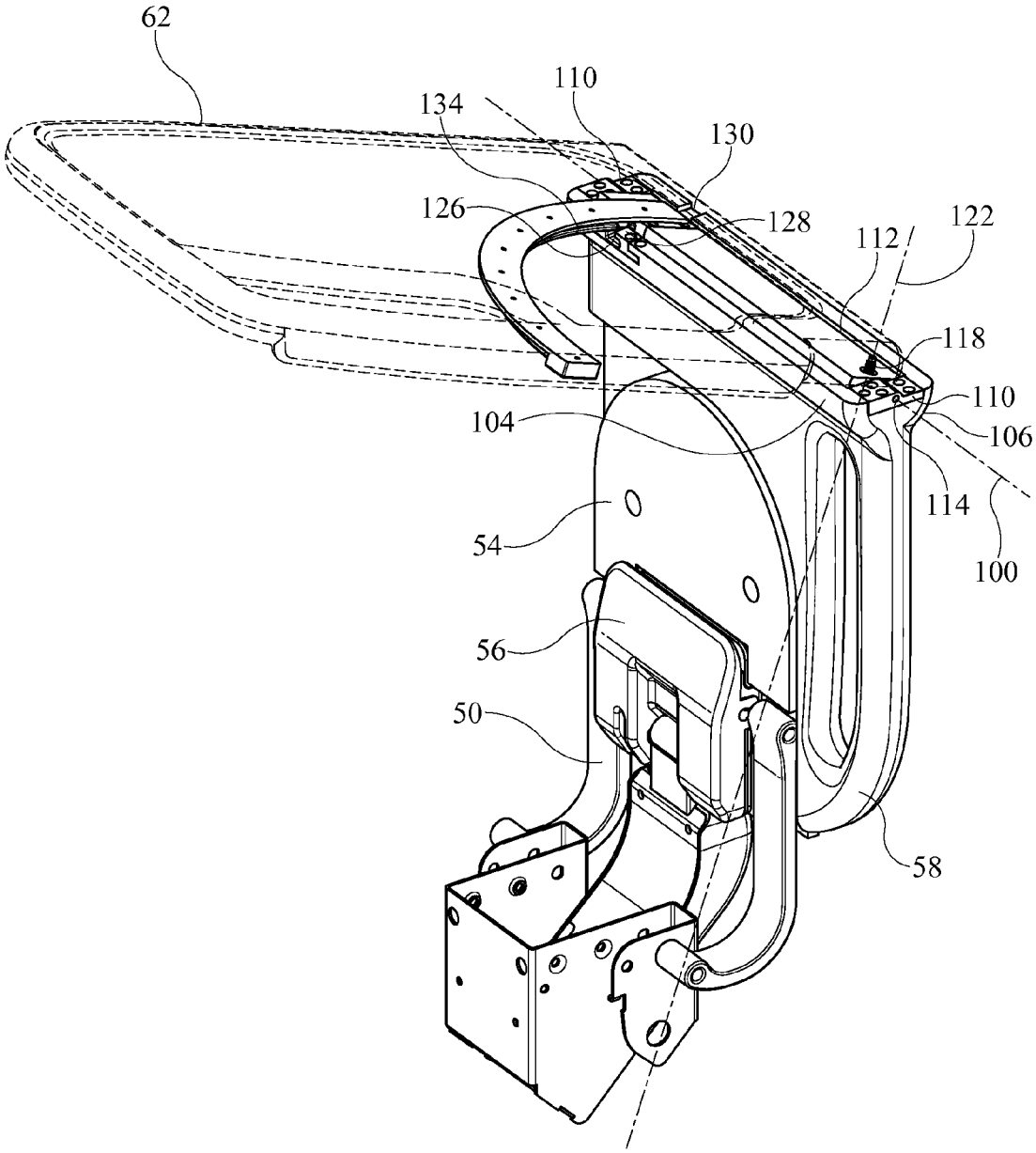
FIG. 14 is a view similar to FIG. 13 with the extension portion of the siderail/over-bed table unit shown in phantom and rotated toward a more horizontal orientation.
Figure 15:
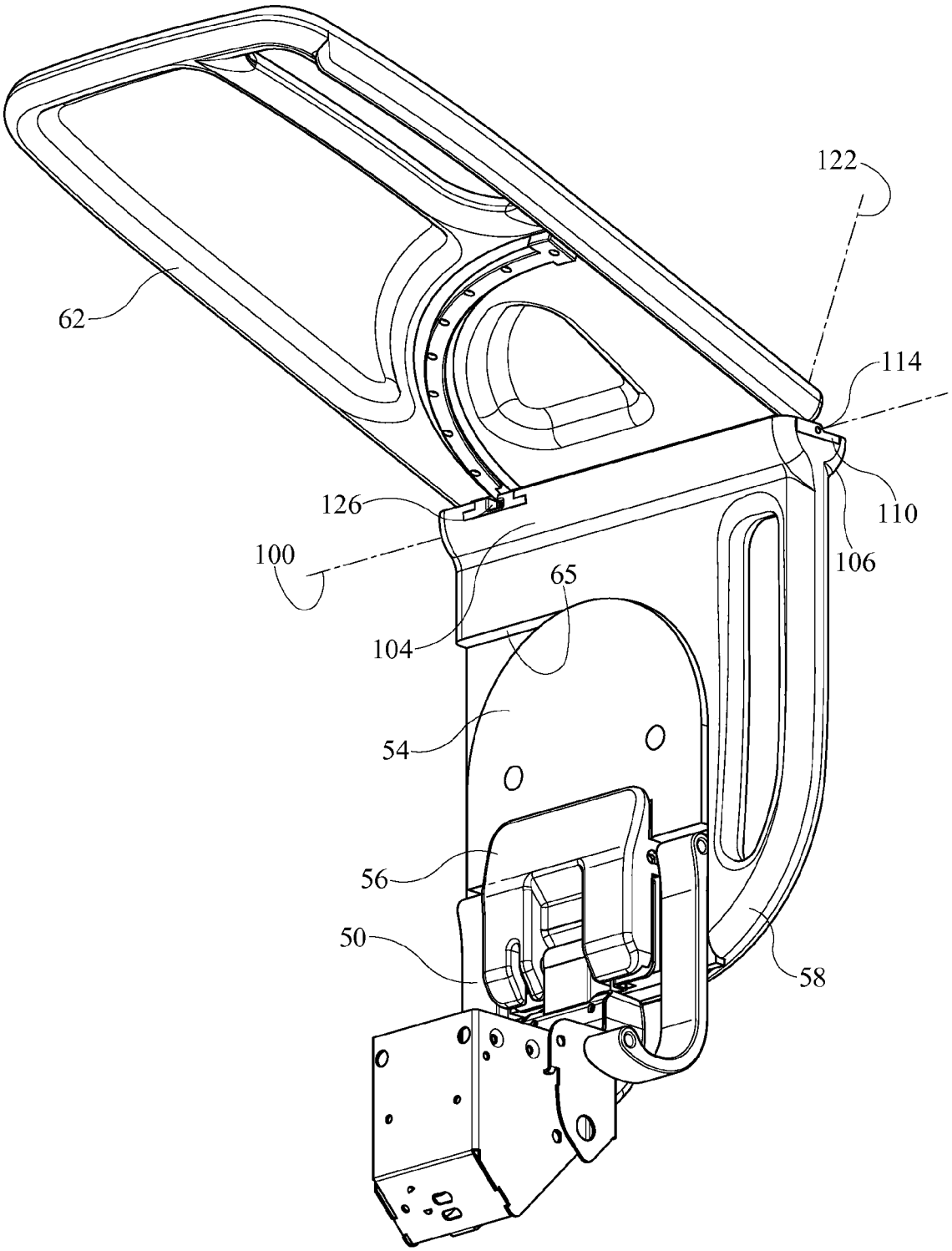
FIG. 15 is a view similar to FIG. 13 showing the siderail/over-bed table unit rotated toward a more horizontal position.

The combined siderail/OBT includes a heel 58 pivotably connected to base plate 54 so that the heel is rotatable about laterally extending heel axis 60. The base plate has two substantially parallel surfaces 59, 61 and a curved surface 63 extending between the parallel surfaces. Surface 61 is more readily visible in FIG. 13. The base plate resides in a recess 64 of the heel. The recess has two substantially perpendicular surfaces 65, 67 and a curved surface 69 extending between the perpendicular surfaces. Surfaces 67 and 69 are more readily visible in FIG. 12; surface 65 is more readily visible in FIG. 15. The siderail/OBT also includes an extension 62 extending from the heel. In the siderail position the heel and extension are substantially coplanar with each other. The extension has a first dimension $d_1$ and a second dimension $d_2$ orthogonal to the first dimension. When the siderail/OBT unit is in the siderail position (FIGS. 1, 2) first dimension $d_1$ extends longitudinally and second dimension $d_2$ extends vertically.

Figure 7:
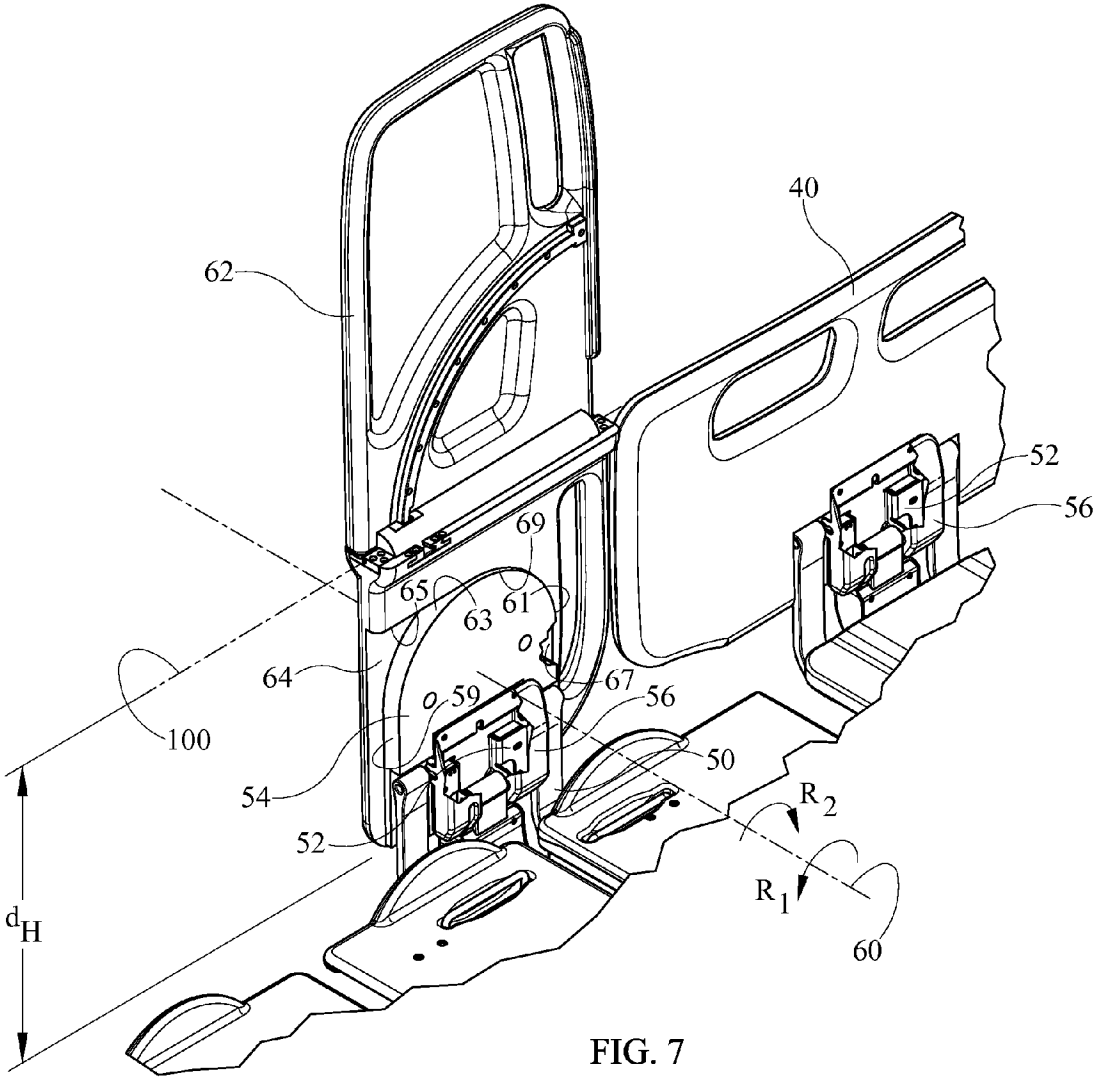
FIG. 7 is a view similar to that of FIG. 2 showing the combined siderail/over-bed table unit having been rotated 90° about a heel axis.

FIGS. 3-6 show further details of the pivotable connection between heel 58 and base plate 54. A latch plate 66 having a central cruciform opening 68 with a set of four equiangularly distributed notches 70 is secured to the base plate 54. The heel includes an opening 72 with a shoulder 74. A laterally translatable button 76 occupies the opening. The button has a face 78, a rim 80, a flange 82, a hub 84 extending from the back of the face and four equiangularly distributed lugs 86 projecting radially from the distal end of the hub. An integral key 90 having an inclined profile extends from the rim to the flange. The key fits into a notch (not illustrated) on the heel to resist rotation of the button relative to the heel about heel axis 60. A compressed spring 92 extends from the back side of the button face, through bore 88 of the hub, and into contact with the base plate. The shoulder 74 cooperates with flange 82 to retain the button in the opening despite the force exerted by the compressed spring. FIGS. 3A and 3B depict the button in a neutral state in which each lug 86 engages a notch 70 in the latch plate 66. As a result of this engagement, rotational movement of heel 58 relative to frame 30, which includes latch plate 66 and base plate 54, is prohibited. When a user wishes to rotate the heel (and the extension) about the heel axis, he depresses the button in a direction parallel to the heel axis 60 as indicated by the arrow F in FIG. 6 so that lugs 86 recede past notches 70 in the latch plate. Rotation of heel 58 about base plate 54 is thus enabled. Once the lugs are in an orientation that places them at least partially behind the inter-notch portions of the latch plate the user has the option to release pressure on the button. When the heel and button next arrive at an orientation at which a lug is circumferentially aligned with a notch, the spring urges the button back to its neutral state so that each lug engages a notch thereby resisting further rotation. FIG. 7 shows the unit after having been pivoted 90 degrees from the orientation of FIG. 1. If desired, heel dimension $d_H$ can be made long enough to impede access to release handle 44 (FIG. 1) when the heel is pivoted to the orientation of FIG. 7.

As seen best in FIG. 2, recess surface 65 engages base plate surface 59 to prevent over-rotation of the heel in direction $R_1$ even if release button 76 is pressed. As seen best in FIG. 7 recess surface 67 engages base plate surface 61 to prevent over-rotation of the heel in direction $R_2$ even if release button 76 is pressed.

Figure 8:
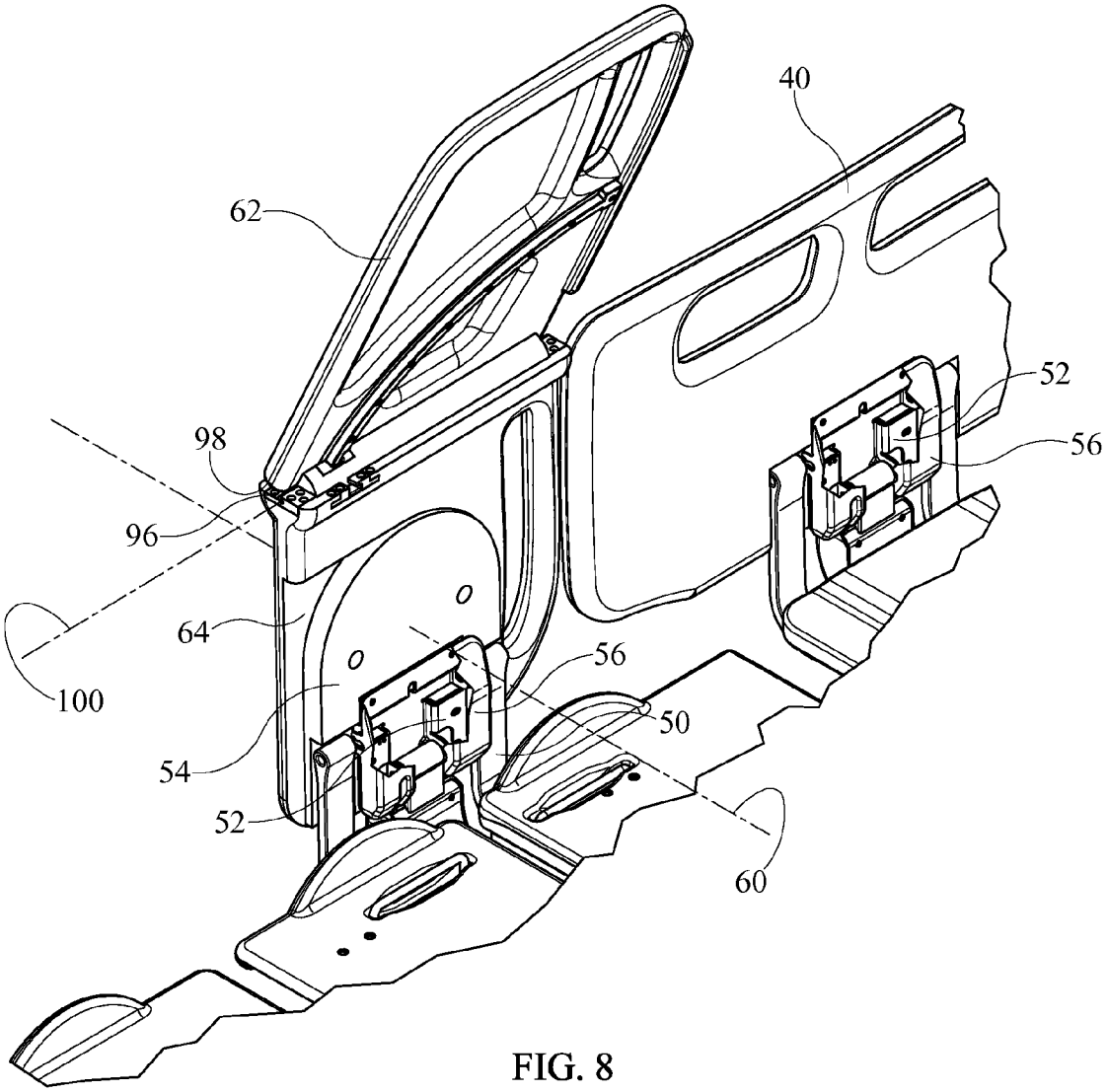
FIG. 8 is a view similar to that of FIG. 7 showing an extension portion of the siderail/over-bed table unit having been rotated about a drop axis relative to a heel portion of the unit.
Figure 9:
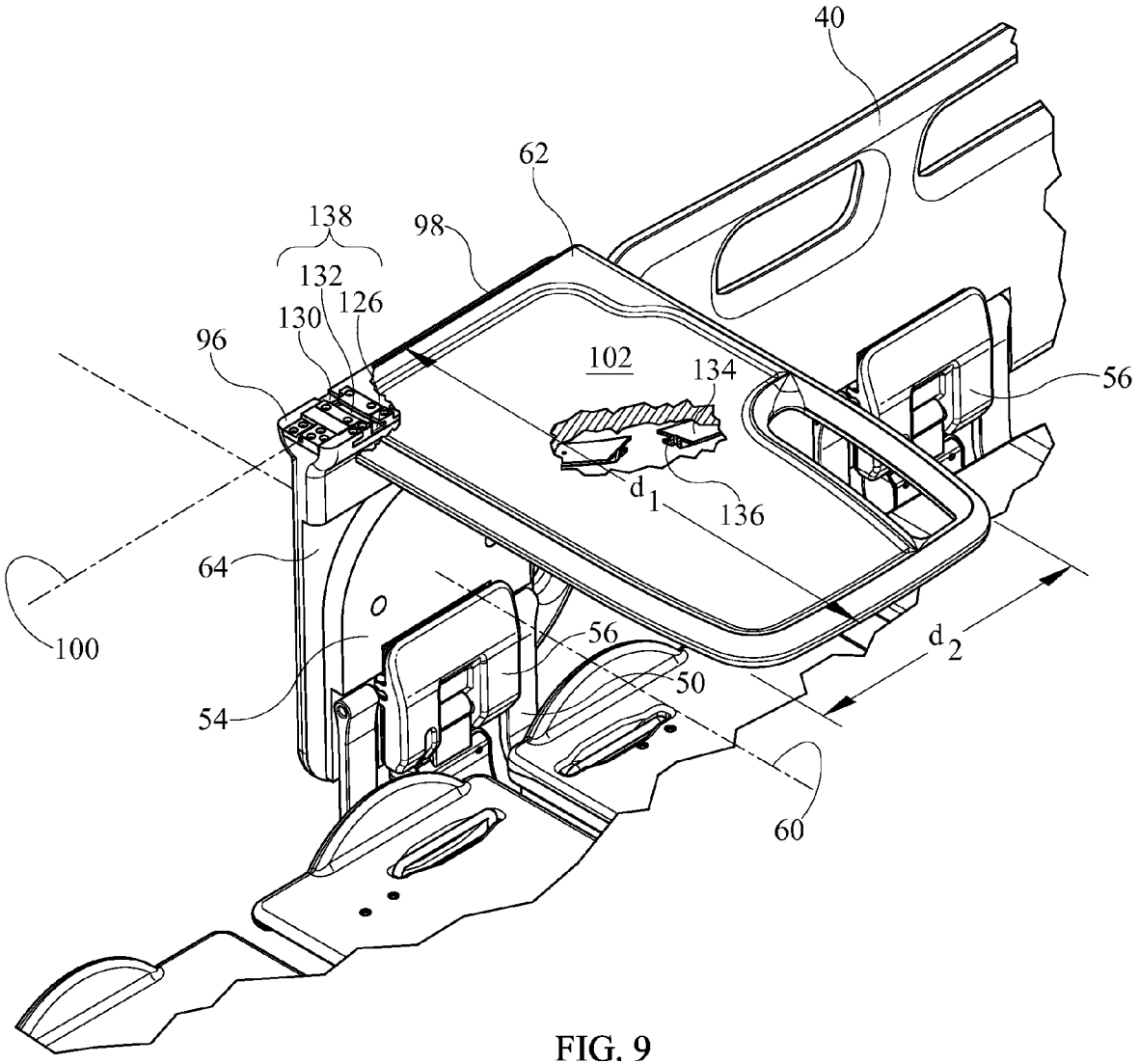
FIG. 9 is a view similar to FIG. 8 showing the extension having been rotated to a substantially horizontal orientation, and with certain portions of the extension broken away to reveal additional features of the siderail/over-bed table unit.
Figure 10:
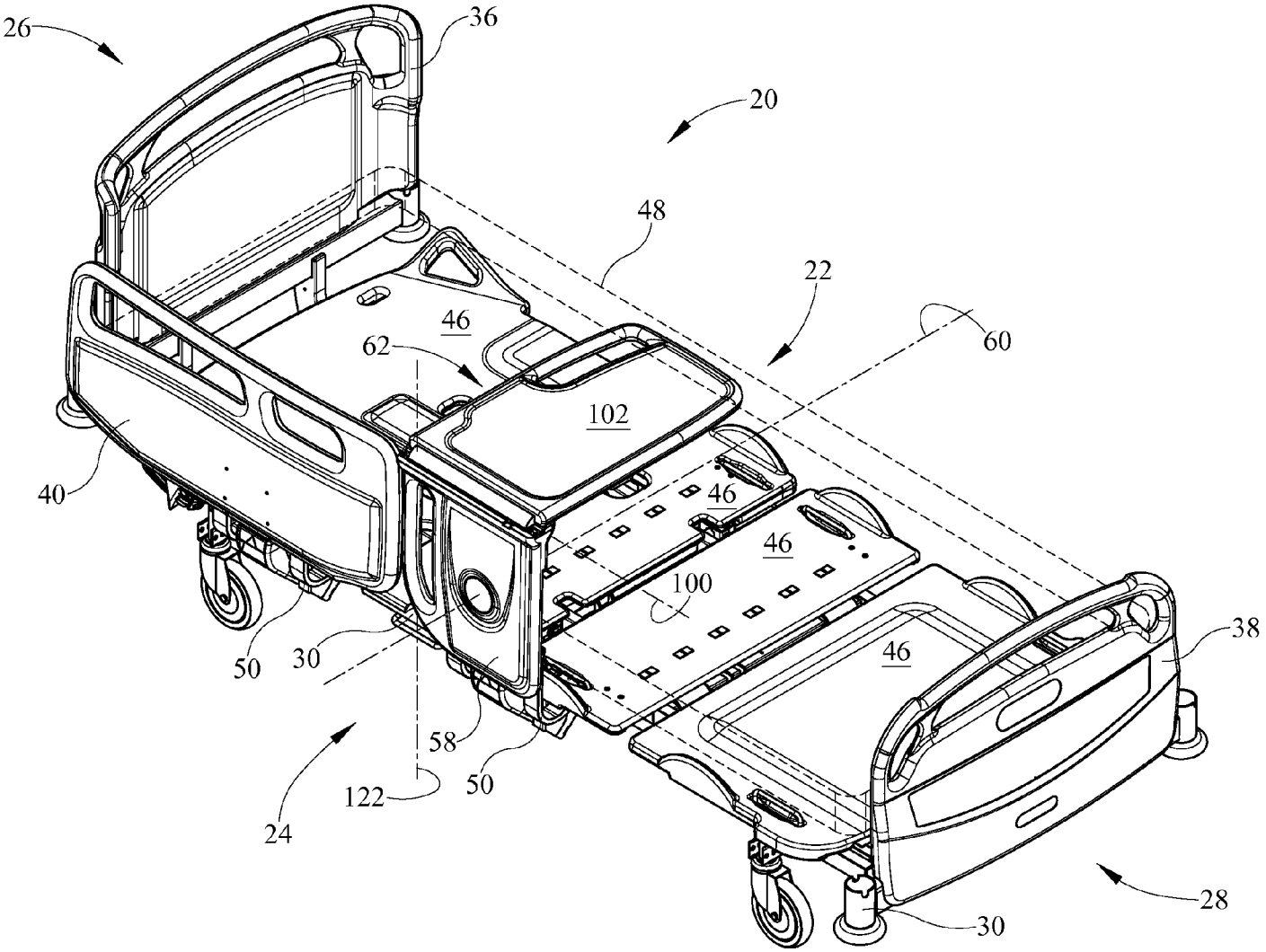
FIG. 10 is a view similar to FIG. 1 showing the siderail/over-bed table unit in the orientation of FIG. 9.
Figure 11:
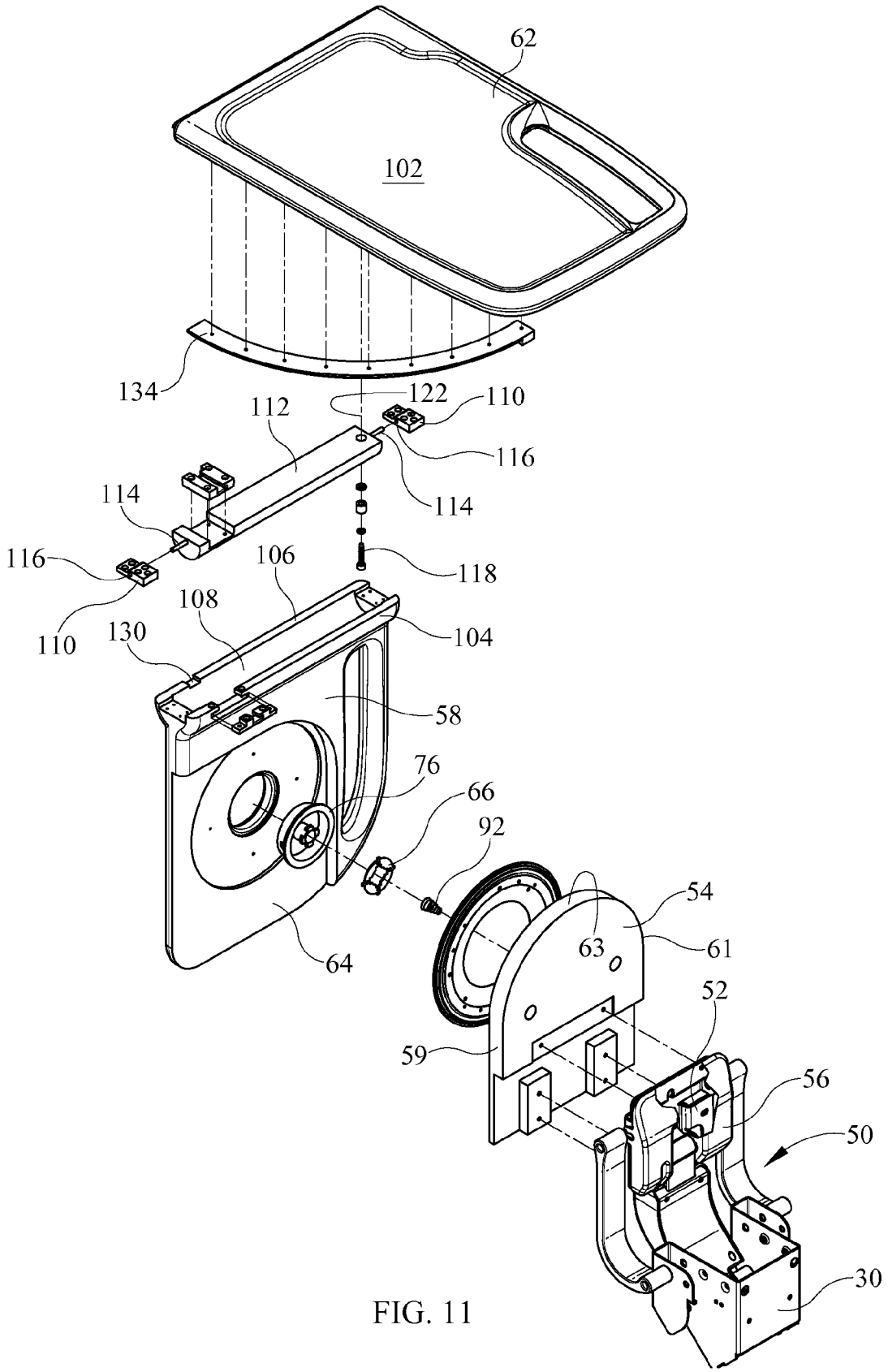
FIG. 11 is an exploded view showing components of the siderail/over-bed table unit.

Referring to FIGS. 8-10 the extension and the heel have mutually proximate ends 96, 98 that face each other when the extension and heel are in the substantially coplanar orientation of FIGS. 1 and 7. The extension is pivotable relative to the heel about a drop axis 100 parallel to the mutually proximate ends. A user would not normally pivot the extension about the drop axis without having first effected the 90 degree orientation change of FIG. 7 (relative to FIG. 1). However once the unit has been positioned as seen in FIG. 7, the extension can be pivoted inboard (i.e. toward the occupant side of the siderail/OBT) about the drop axis (FIG. 8) and placed in a table position, seen in FIGS. 9 and 10, in which the extension, or at least a substantial portion thereof, overlies mattress region 48 with the extension, or at least a table surface 102 thereof, in a horizontal orientation thereby serving as an over-bed table for the occupant. When the unit is in the table position, the extension extends predominantly in the longitudinal and lateral directions so that the first dimension $d_1$ extends laterally and the second dimension $d_2$ extends longitudinally.

FIGS. 11-15 shows further details of the heel and extension. End 96 of the heel is flared to define an inboard wall 104 and an outboard wall 106 with a semi-cylindrical trough 108 between the walls. Bridges 110 span between the walls. A semi-cylindrical roller 112 resides in the trough and is retained therein by a pair of hinge pins 114 each of which projects from the roller and extends into an opening 116 in the adjacent bridge 110. The pins define the drop axis 100.

A stud 118 projects from the roller near one of the bridges. The stud defines a swing axis 122, which is perpendicular to drop axis 100. Near the other bridge an L-shaped groove 126 extends through inboard wall 104 and is partially bordered by an overhang 128. A rectangular groove 130 extends through the outboard wall. An L-shaped groove 132 extends through the roller. When the extension and heel are in the relative orientation of FIG. 10, the L-shaped and rectangular grooves 126, 130, 132 cooperate with each other to define a guide slot 138 in the heel. A curved rail 134, also partially visible in FIG. 13, projects from the underside of the extension. The rail has a nominal radius of curvature R (FIG. 13) centered on the swing axis 122. One end 135 of the rail has a rectangular profile. Most of the rail has an L-shaped profile with a foot portion 136 (FIG. 9).

Figure 16:
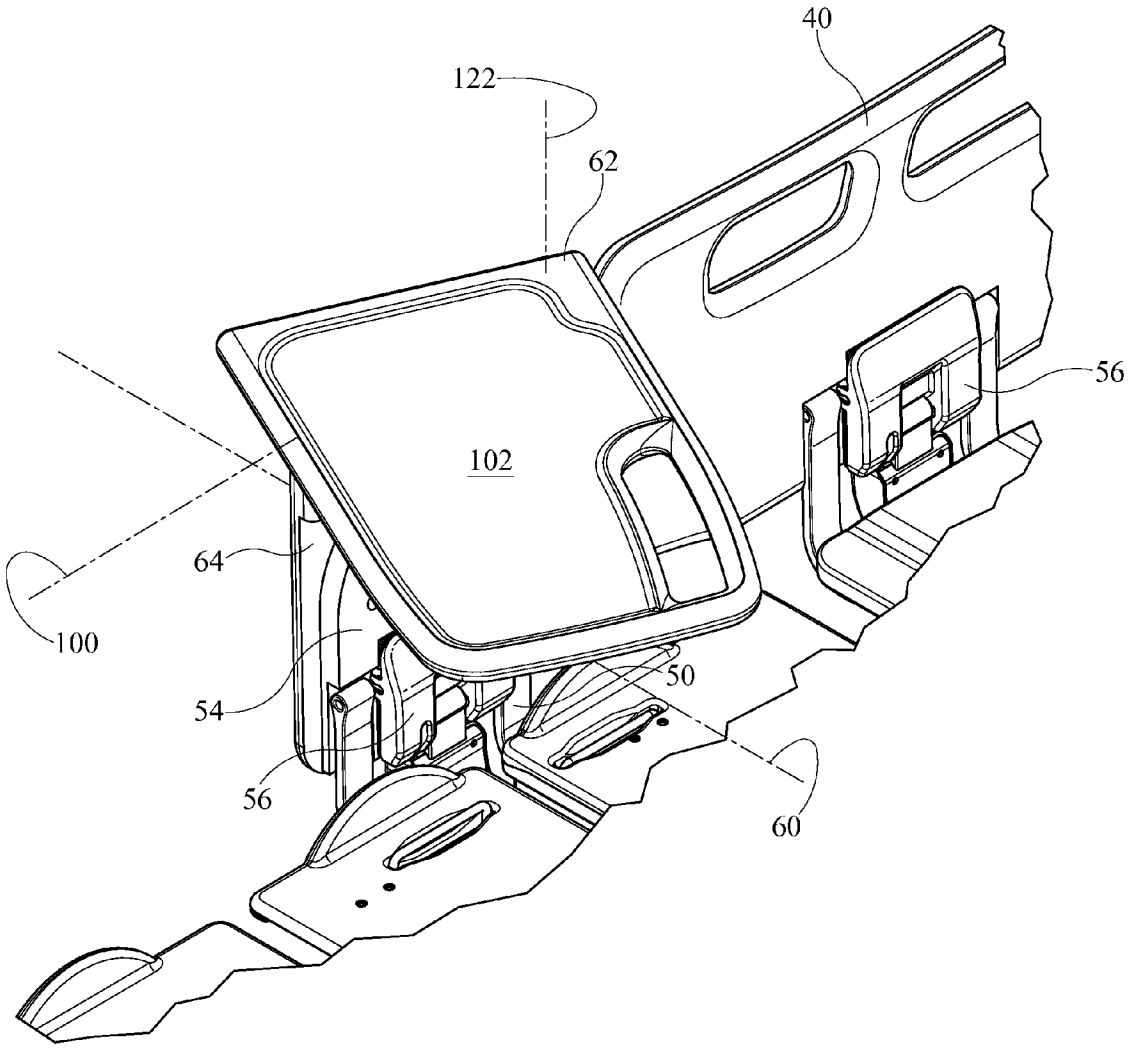
FIG. 16 is a view similar to FIG. 9 showing the extension portion of the siderail/over-bed table unit rotated slightly about a swing axis.
Figure 17:
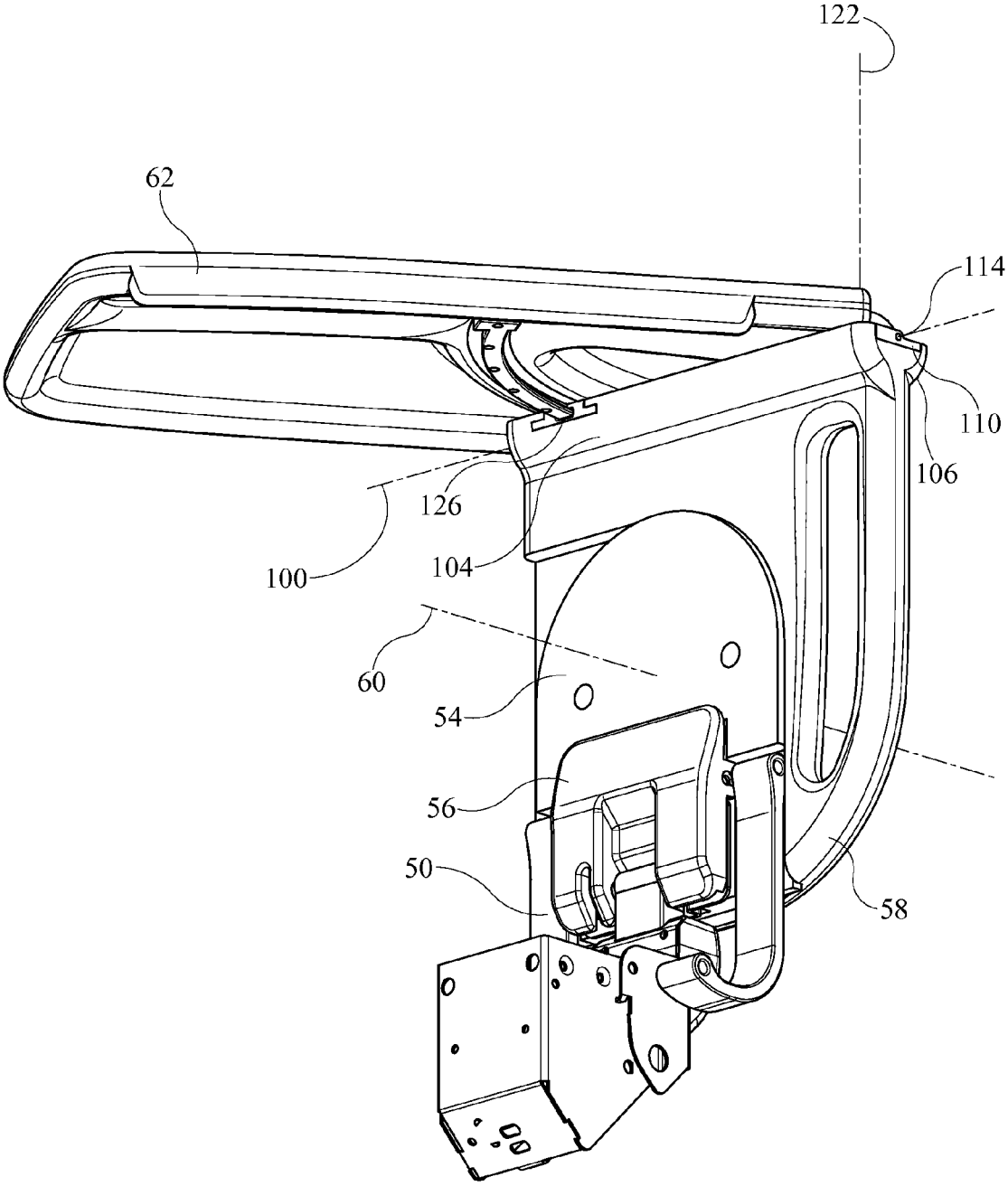
FIG. 17 is a view similar to FIG. 16 showing the extension portion as seen from underneath and further rotated about the swing axis.
Figure 18:
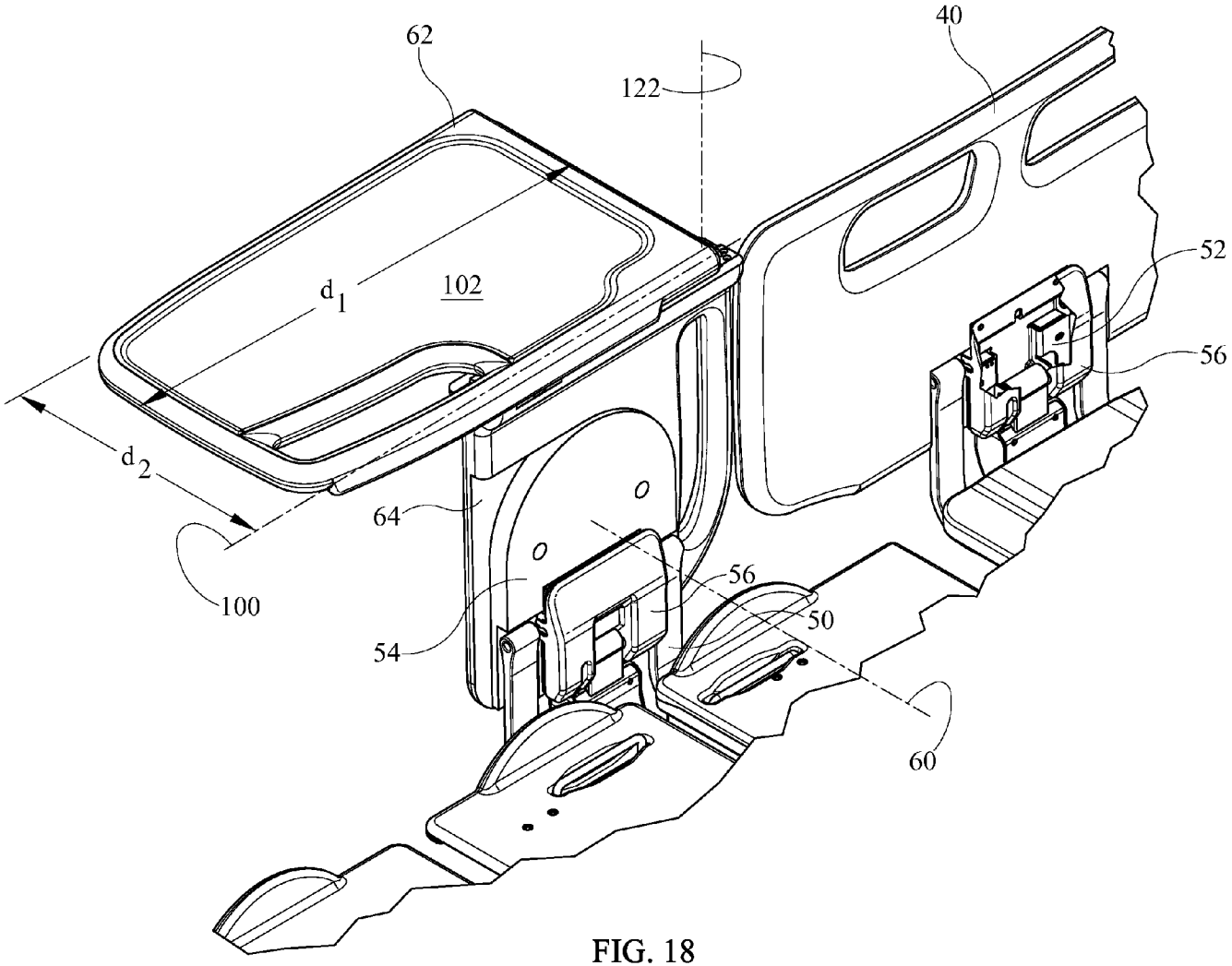
FIG. 18 is a view similar to FIG. 16 showing the extension portion further rotated about the swing axis.

When the heel and the extension are in the coplanar relative orientation of FIG. 7, the extension is rotatable about the drop axis 100, but not about swing axis 122 because end 96 of the heel contacts end 98 of the extension to block rotation of the extension about the swing axis. As the extension is lowered toward a 90 degree relative orientation (FIG. 8), any significant rotation about the swing axis is similarly impeded. When the extension is at the 90 degree orientation (FIGS. 9 and 10) its underside is substantially parallel to end 96 of the heel and rests on the inboard wall 104 of the heel. In addition the rail 134 registers with the guide slot 138. Accordingly, as seen in FIG. 16-18, a user can pivot the extension about swing axis 122 to swing the extension laterally outwardly to a secondary position (FIG. 18) at which the first dimension $d_1$ extends predominantly longitudinally and the second dimension $d_2$ extends predominantly laterally. Swinging the extension about the swing axis causes rail 134 to engage guide slot 138. After the rail enters the guide slot, rail foot 136 cooperates with wall overhang 128 to prevent upward rotation of the extension about drop axis 100. The guide slot 138 may have a nominal radius of curvature substantially equal to the radius of curvature R of the rail 134 or may be a linearly extending slot dimensioned to accommodate rotation of the rail about the swing axis.

Figure 19:
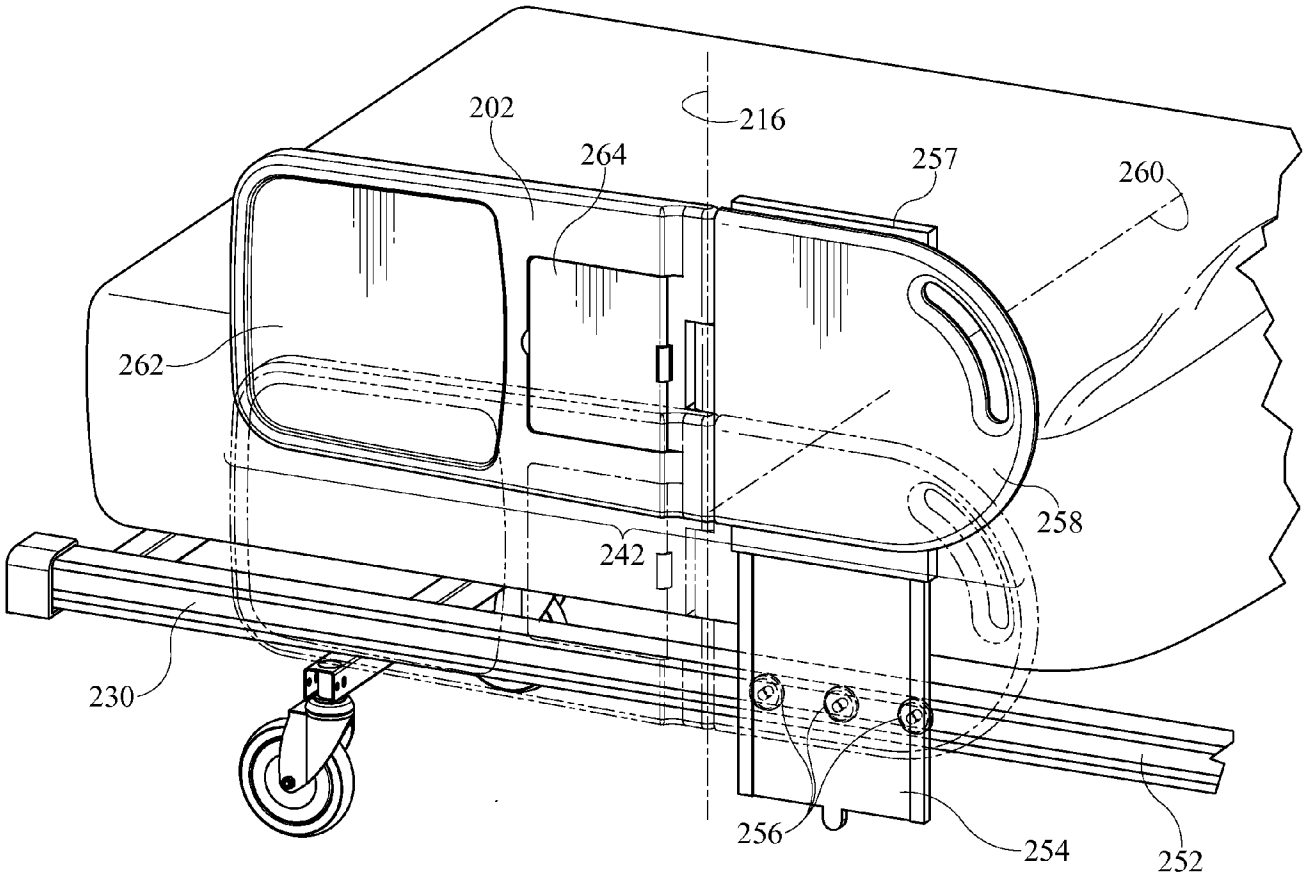
FIG. 19 is a perspective view of a portion of a hospital bed showing a second embodiment of a siderail/over-bed table in both a raised (solid lines) and a lowered (phantom) position.

FIGS. 19-24 show an alternative embodiment 242 of the combination siderail/OBT unit. Referring first to FIG. 19, the bed frame 230 includes a longitudinally extending track 252. A support plate 254 is translatably joined to the track, for example by rollers 256. A sleeve 257 is connected to the support plate and is vertically translatable relative to the support plate. The siderail/OBT unit has a heel portion 258 pivotably connected to the sleeve so that the heel is pivotable about heel axis 260. An extension 262 extends from the heel and is pivotably connected thereto so that the extension is pivotable relative to the heel about drop axis 216. The slidable connection between sleeve 257 and support plate 254 allows the unit to be adjusted between a raised position (solid lines) and a lowered position (phantom) below the top surface of the mattress.

Figure 20:
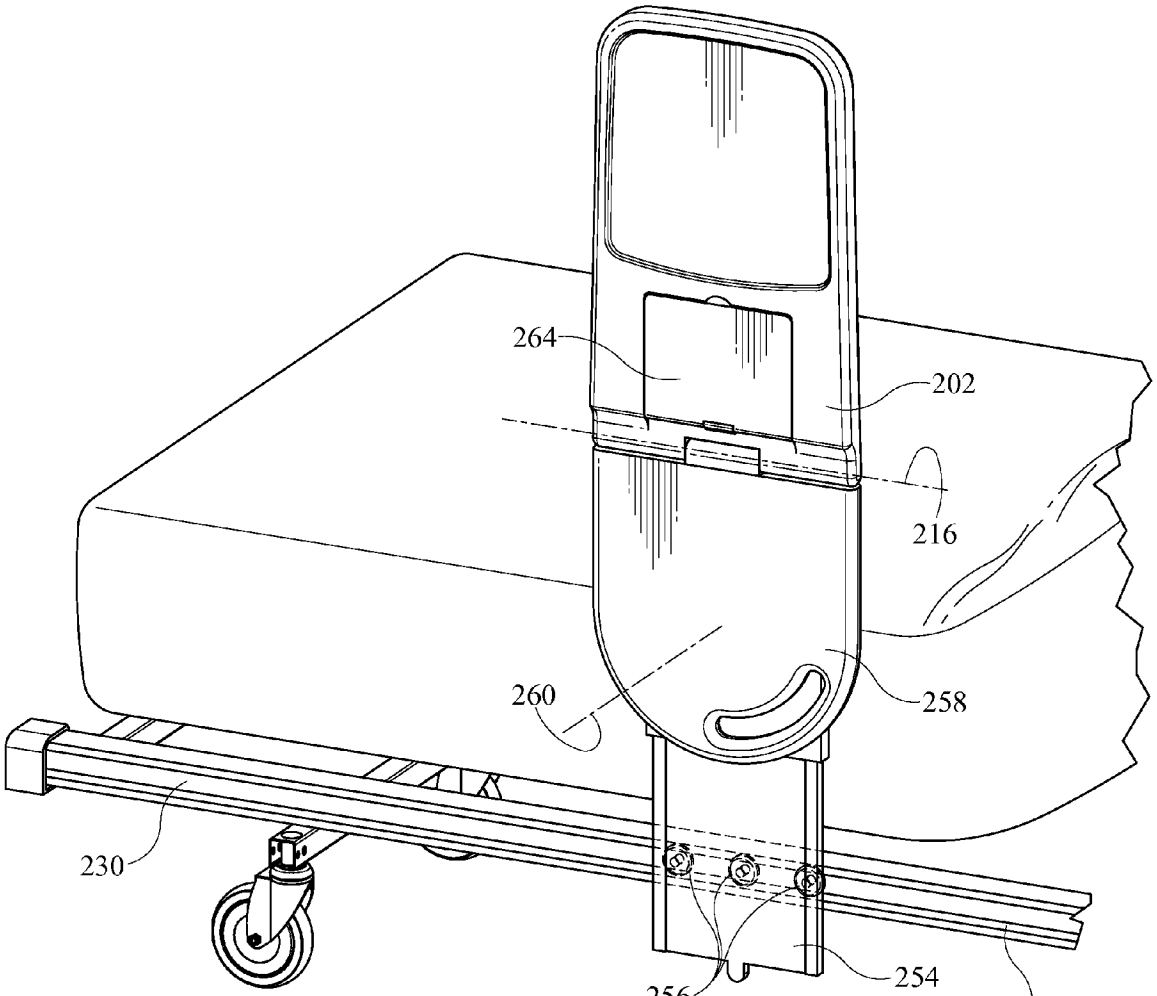
FIG. 20 is a view similar to FIG. 19 showing the combined siderail/over-bed table unit rotated 90° about the heel axis.
Figure 21:
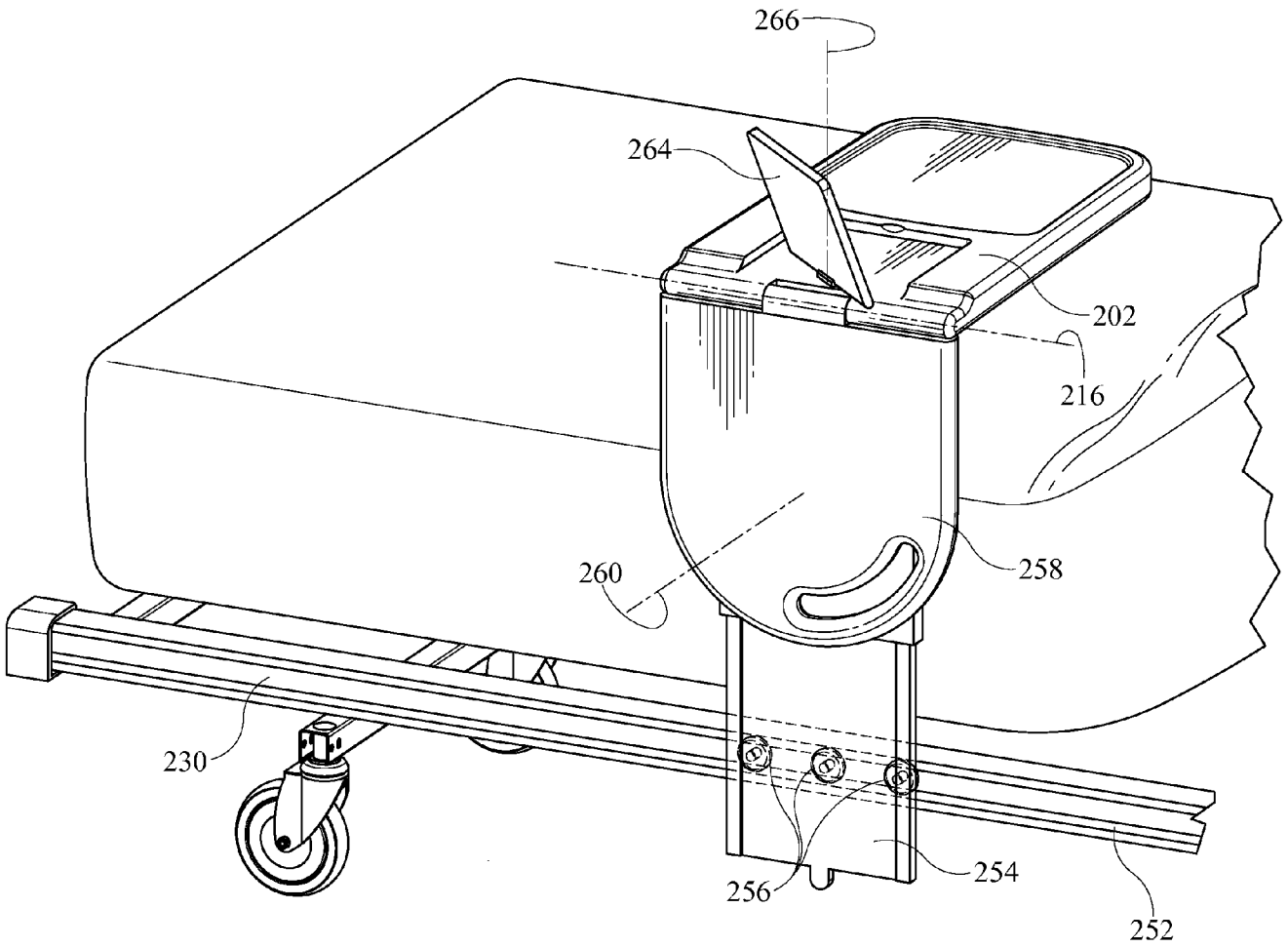
FIG. 21 is a view similar to FIG. 20 showing an extension portion of the unit rotated 90° about a drop axis and also showing an occupant interface device unfolded from a surface of the extension.

FIG. 20 shows the unit after a user has pivoted the heel, and therefore the extension as well, ninety degrees about heel axis 260. FIG. 21 shows the unit in the table position achieved by subsequently pivoting the extension 90 degrees about the drop axis 216.

The siderail/OBT unit also includes an occupant interface device 264 that folds down flush with table surface 202 as seen in FIGS. 19-20 and unfolds away from surface 202 as seen in FIG. 21. Device 264 is pivotable about a device axis 266. Examples of the specific types of devices include a keypad allowing the occupant to command certain functions of the bed, and an information display.

Figure 22:
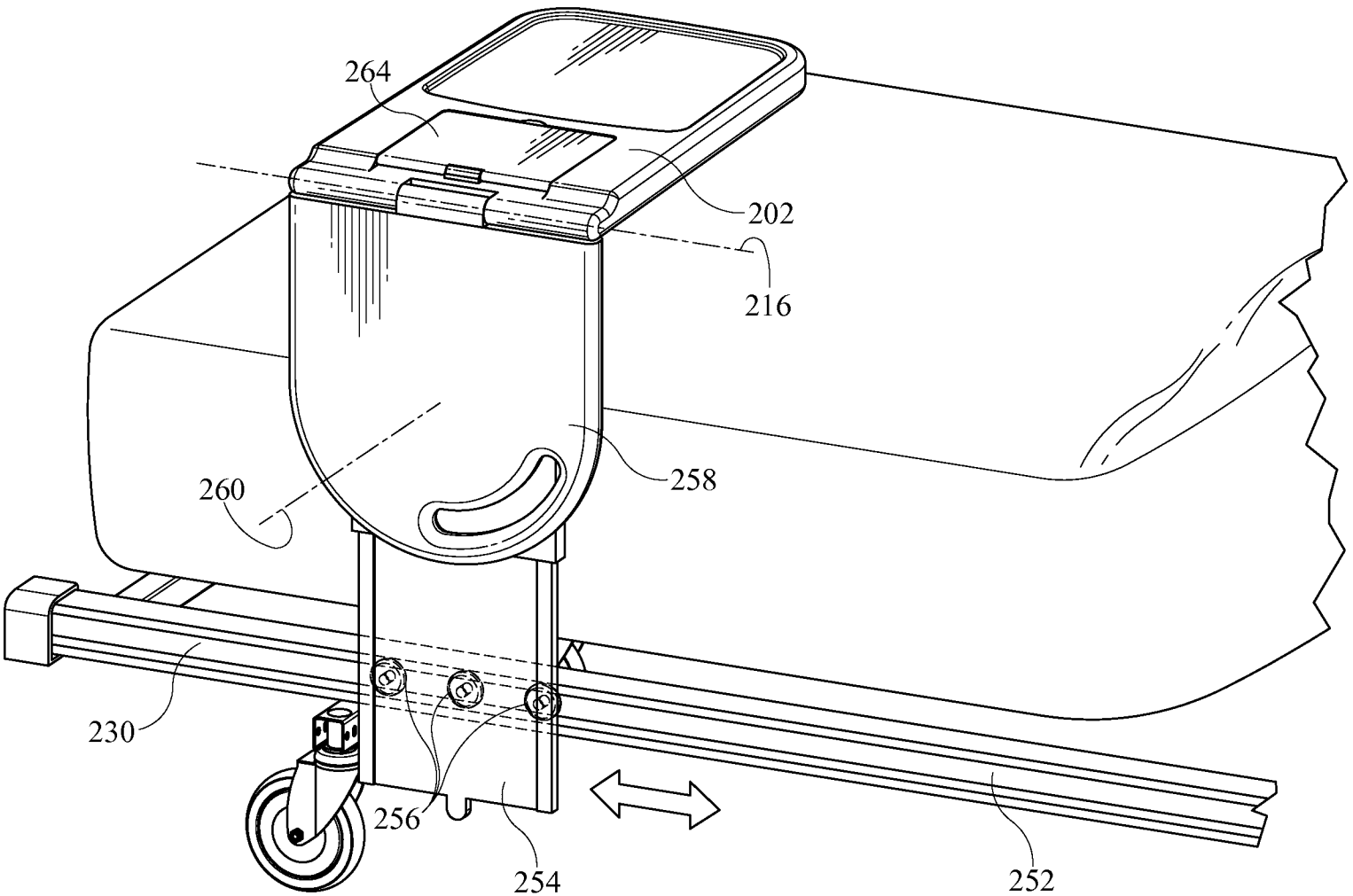
FIG. 22 is a view similar to FIG. 21 with the siderail/over-bed table unit translated more toward the foot end of the bed.

FIG. 22 shows the unit having been longitudinally translated relative to its position in FIG. 21. The translatability is a consequence of the translatable connection between support plate 254 and track 252.

Figure 23:
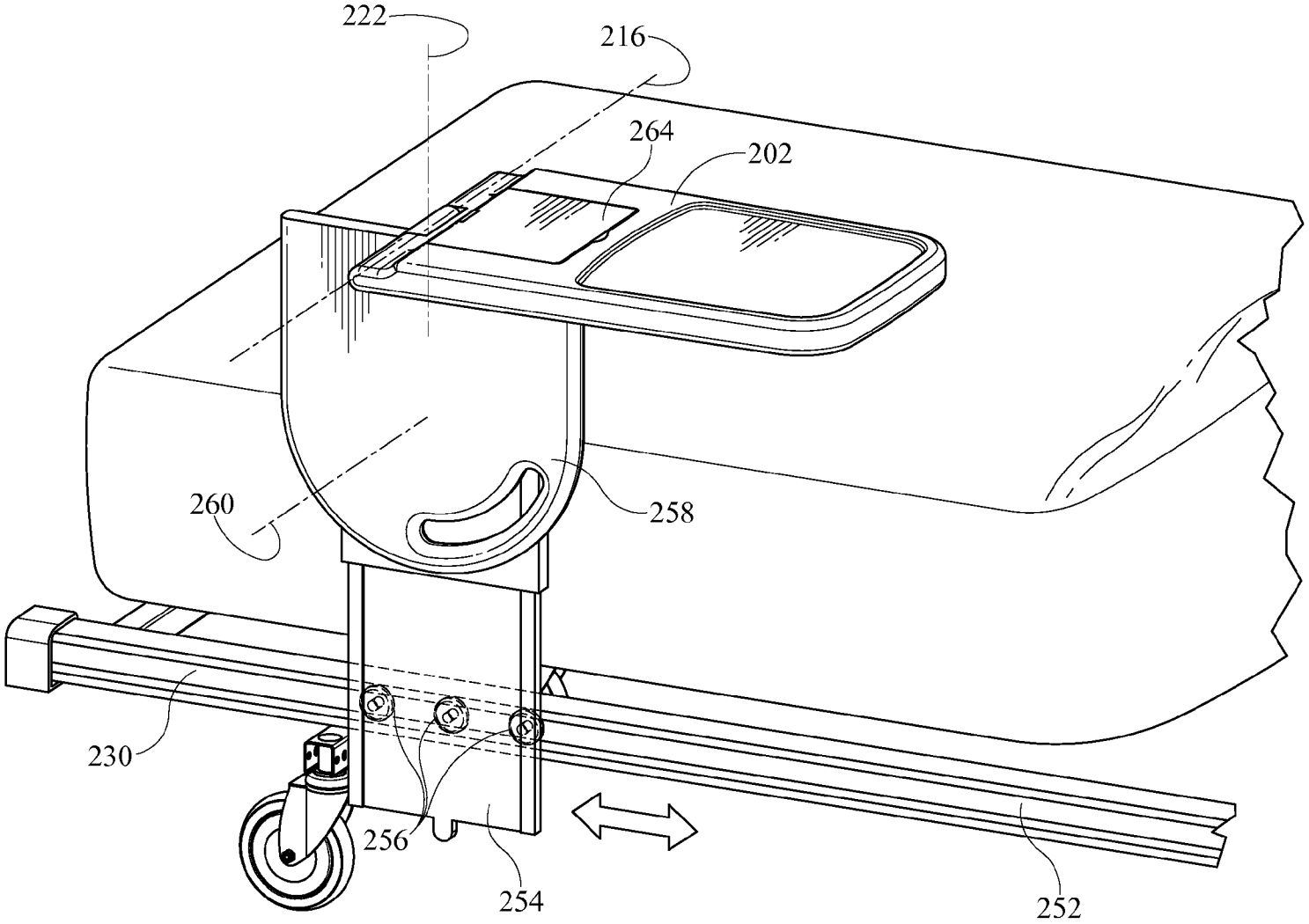
FIG. 23 is a view similar to FIG. 22 showing the extension portion of the unit rotated approximately 90° about a swing axis toward the head end of the bed.
Figure 24:
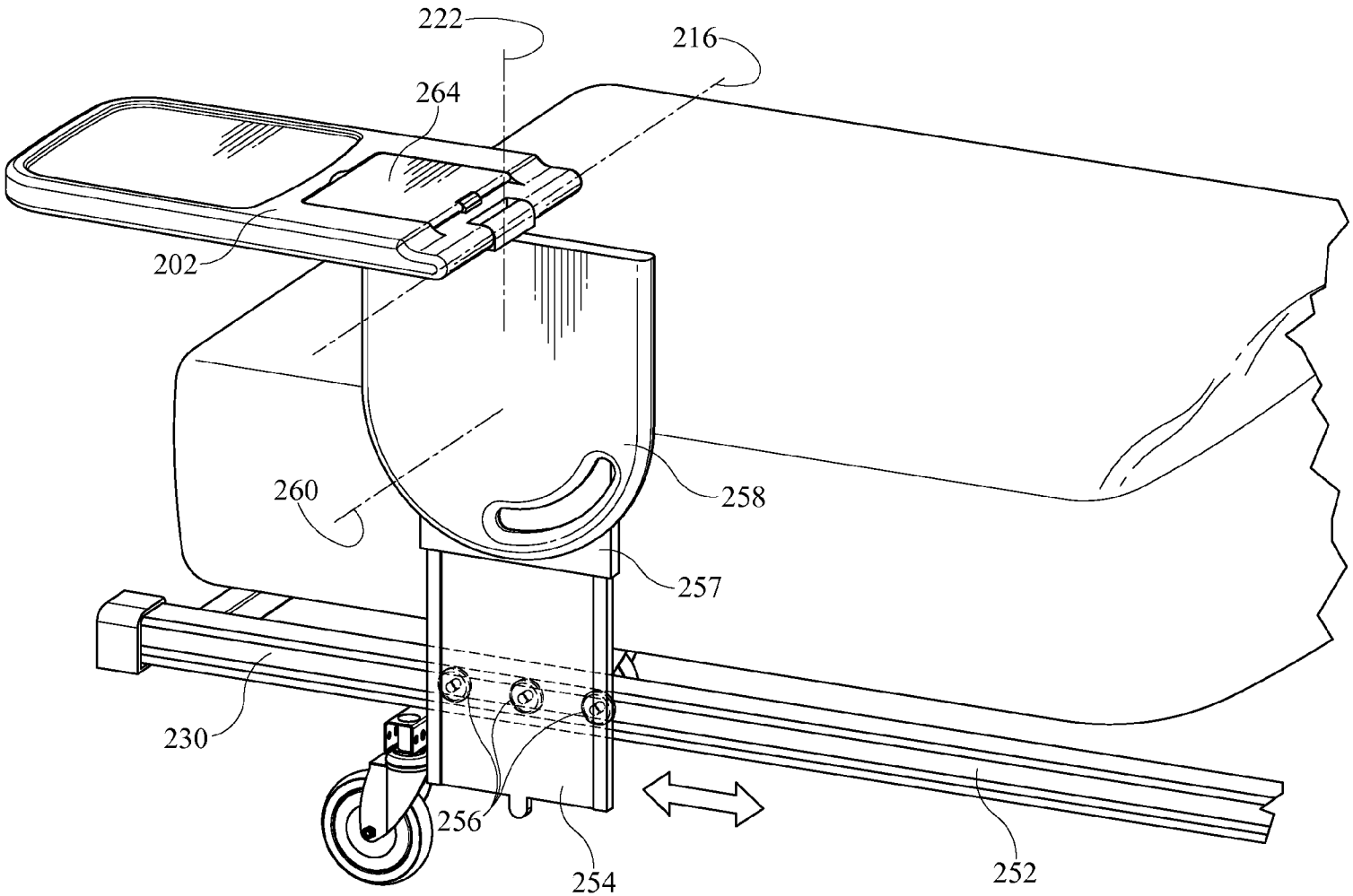
FIG. 24 is a view similar to FIG. 22 showing at the extension portion of the unit rotated approximately 90° about a swing axis toward the foot end of the bed.

As seen in FIGS. 23 and 24 the extension is also pivotable relative to the heel about a swing axis 222.

Although the various embodiments of the unit are useful as an over-bed table, they retain, when in the siderail position, all the typical functionality of a siderail. For example they can be raised to a deployed position to define the lateral edges of the mattress and can be retracted to a stowed position to allow for occupant ingress and egress and to allow an attendant to access the occupant. The extension plays two mutually exclusive roles. It serves as part of the siderail when the unit is in the siderail position, but serves as a table when the unit is in the table or secondary position. Even when the unit is in the table position, part of the unit (heel 58 of the first embodiment and support plate 254 and sleeve 257 of the second embodiment) are at least partially effective as a siderail insofar as those parts define the lateral edge of the mattress.

Although this disclosure refers to specific embodiments, it will be understood by those skilled in the art that various changes in form and detail may be made without departing from the subject matter set forth in the accompanying claims.

We claim:

1. A patient support apparatus comprising:

a frame;

a deck supported by the frame; and a siderail comprising a table portion movable between a table position in which the table portion extends generally horizontally over at least a portion of the deck and is spaced from the deck, and a siderail position in which the table portion extends generally vertically along at least a portion of a side of the deck.

2. The patient support apparatus of claim 1, comprising a main siderail portion and a hinge rotatably connecting the table portion to the main siderail portion.

3. The patient support apparatus of claim 2 wherein the table portion and the main siderail portion both extend generally vertically along at least the portion of the side of the deck when the table portion is in the siderail position.

4. The patient support apparatus of claim 1, wherein the siderail is movable from a deployed position in which a majority of the siderail is higher than the deck and a stored position in which a majority of the siderail is lower than the deck.

5. The patient support apparatus of claim 4 further comprising a latch for latching the siderail in the deployed position.

6. The patient support apparatus of claim 1 in which the table portion of the siderail is an extension portion.

7. The patient support apparatus of claim 2 in which the main siderail portion of the siderail is a heel and the table portion of the siderail is an extension.

8. The patient support apparatus of claim 7 wherein the frame includes a mechanism connected to the siderail enabling the siderail to be raised and lowered relative to the deck, and wherein the heel is connected to the mechanism and is pivotable about a heel axis relative to the mechanism, and wherein the extension extends from the heel and is pivotable relative thereto about a drop axis.

9. The patient support apparatus of claim 8 wherein with the table portion of the siderail in the siderail position:

a) the heel and extension are substantially coplanar with each other such that the siderail extends predominantly in the longitudinal and vertical directions and borders a lateral side of the deck;

b) the heel axis extends substantially laterally;

c) the drop axis extends substantially vertically;

and wherein with the table portion of the siderail in the table position:

a) the heel borders the lateral side of the deck;

b) the heel extends predominantly in the longitudinal and vertical directions;

c) the extension extends predominantly in the longitudinal and lateral directions;

d) the heel axis extends substantially laterally; and e) the drop axis extends substantially longitudinally.

10. The patient support apparatus of claim 7 wherein with the table portion in the table position the extension defines a substantially horizontal table having a first dimension and a second dimension substantially orthogonal to the first dimension.

11. The patient support apparatus of claim 10 wherein the hinge defines a drop axis and the extension is pivotable relative to the heel about a swing axis which is substantially perpendicular to the drop axis.

12. The patient support apparatus of claim 11 wherein the extension is pivotable relative to the heel between a first table position in which the first dimension extends in the longitudinal direction and the second dimension extends in the lateral direction, and a second table position in which the table is still horizontal and the first dimension extends laterally and the second dimension extends longitudinally.

13. The patient support apparatus of claim 12 wherein the second table position is a position substantially laterally outboard of the deck.

14. The patient support apparatus of claim 7 wherein the heel and extension have mutually proximate edges and the extension is pivotable relative to the heel about a drop axis substantially parallel to the mutually proximate edges.

15. The patient support apparatus of claim 14 wherein the extension is pivotable relative to the heel about a swing axis perpendicular to the drop axis.

16. The patient support apparatus of claim 8 wherein only when the table portion is in the table position the extension is also pivotable relative to the heel about a swing axis perpendicular to the drop axis.

17. The patient support apparatus of claim 7 comprising:

a curved rail projecting from an underside of the extension; and a guide slot in the heel, the guide slot and the rail being engageable with each other only when the extension and the heel are oriented substantially perpendicular to each other.

18. The patient support apparatus of claim 17 wherein engagement of the rail and the guide slot prevents upward rotation of the extension about the hinge.

19. The patient support apparatus of claim 18 in which the hinge defines a drop axis, the rail includes a foot, and the slot includes an overhang, and in which the rail foot cooperates with the overhang to prevents upward rotation of the extension about the drop axis.

20. The patient support apparatus of claim 7 in which the table portion is positionable in a position intermediate the siderail position and the table position, the intermediate position being one in which the heel and extension are substantially coplanar with each other, a heel axis extends substantially laterally and a drop axis extends substantially longitudinally.

21. The patient support apparatus of claim 20 wherein when the table portion is in the intermediate position and the extension and the heel are in a coplanar relative orientation, the extension is rotatable about the drop axis but not about a swing axis.

* * * * *